US009883280B2

(12) United States Patent
Oosato et al.

(10) Patent No.: US 9,883,280 B2
(45) Date of Patent: Jan. 30, 2018

(54) HEADPHONE AND ACOUSTIC CHARACTERISTIC ADJUSTING METHOD

(71) Applicant: SONY CORPORATION, Tokyo (JP)

(72) Inventors: Yuusuke Oosato, Tokyo (JP); Takahiro Suzuki, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 14/911,494

(22) PCT Filed: Jul. 2, 2014

(86) PCT No.: PCT/JP2014/067668

§ 371 (c)(1),
(2) Date: Feb. 11, 2016

(87) PCT Pub. No.: WO2015/022817

PCT Pub. Date: Feb. 19, 2015

(65) Prior Publication Data

US 2016/0192065 A1 Jun. 30, 2016

(30) Foreign Application Priority Data

Aug. 12, 2013 (JP) ..... 2013-167754

(51) Int. Cl.

| | |
|---|---|
| ***H04R 25/00*** | (2006.01) |
| ***H04R 1/28*** | (2006.01) |
| *H04R 1/10* | (2006.01) |
| *H04R 11/02* | (2006.01) |

(52) U.S. Cl.

CPC ..... *H04R 1/2826* (2013.01); *H04R 1/2819* (2013.01); *H04R 1/2857* (2013.01); *H04R 1/1008* (2013.01); *H04R 1/1016* (2013.01); *H04R 11/02* (2013.01); *H04R 2460/11* (2013.01)

(58) Field of Classification Search

CPC .. H04R 1/2826; H04R 1/2807; H04R 1/2823; H04R 1/2846

USPC ..... 381/345–348, 349, 351, 386, 337, 370, 381/371, 374, 376

See application file for complete search history.

(56) References Cited

U.S. PATENT DOCUMENTS

| | | | | |
|---|---|---|---|---|
| 4,239,945 A * | 12/1980 | Atoji | H04R 1/2819 381/349 |
| 6,668,064 B1 * | 12/2003 | Lin | H04R 1/1016 381/328 |
| 2011/0058704 A1 * | 3/2011 | Harlow | H04R 1/1016 381/380 |

FOREIGN PATENT DOCUMENTS

| | | | |
|---|---|---|---|
| JP | SHO 55-165568 | A | 11/1980 |
| JP | SHO 61-078492 | A | 5/1986 |
| JP | HEI 02-133090 | A | 11/1990 |
| JP | HEI 04-227396 | A | 8/1992 |

(Continued)

*Primary Examiner* — Sunita Joshi

(74) *Attorney, Agent, or Firm* — CHIP LAW GROUP

(57) ABSTRACT

[Object] To make it possible to improve an acoustic characteristic.

[Solution] There is provided a headphone including a driver unit that includes a diaphragm, a housing that accommodates the driver unit, and forms a sealed-type front-face air chamber spatially blocked from an outside except for an opening for sound output on a front face side provided with the diaphragm of the driver unit, and an acoustic tube whose end is directly connected to a first ventilation hole provided in a frame of the driver unit, and that spatially connects a driver-unit rear-face air chamber formed between the frame and the diaphragm with the outside of the driver unit via a tube.

19 Claims, 18 Drawing Sheets

(56) References Cited

FOREIGN PATENT DOCUMENTS

| | | | |
|---|---|---|---|
| JP | 2007-028375 | A | 2/2007 |
| JP | 2007-189468 | A | 7/2007 |
| JP | 2009-219122 | A | 9/2009 |
| JP | 2011-234102 | A1 | 11/2011 |

* cited by examiner

HEADPHONE AND ACOUSTIC CHARACTERISTIC ADJUSTING METHOD

TECHNICAL FIELD

The present disclosure relates to a headphone and an acoustic characteristic adjusting method.

BACKGROUND ART

Typically in a headphone, a driver unit disposed within a housing drives a diaphragm according to an audio signal to thereby vibrate air to generate sound. Here, it is known that an acoustic characteristic of the headphone depends on a structure within the housing. Specifically, the acoustic characteristic of the headphone can vary according to the volume of a space provided within the housing, a size of a ventilation hole, which can be a passage of air, formed within the housing, or the like. Therefore, a number of techniques on the structure within the housing have been proposed.

There has been disclosed a sealed-type canal-type earphone in which a space spatially blocked from the outside, except for an opening for outputting sound toward the outside, is formed between a housing and a front face side as a side provided with a diaphragm of a driver unit (see, for example, Patent Literature 1). Furthermore, there has been disclosed a technique for improving an acoustic characteristic by providing a tubular duct unit, which spatially connects between the inside and the outside of a housing, on a rear side of the housing as a side opposite to the side provided with a diaphragm of a driver unit (see, for example, Patent Literature 2).

CITATION LIST

Patent Literature

Patent Literature 1: JP 2007-189468A
Patent Literature 2: JP H4-227396A

SUMMARY OF INVENTION

Technical Problem

However, requirements to an acoustic characteristic, such as a desire to emphasize an output of sound in a low range, differ depending on the intended use of a headphone. Therefore, a desired acoustic characteristic is not always obtained by applying the techniques described in Patent Literature 1 and Patent Literature 2 to the headphone.

Accordingly, the present disclosure proposes a novel and improved headphone and acoustic characteristic adjusting method, capable of further improving an acoustic characteristic.

Solution to Problem

According to the present disclosure, there is provided a headphone including: a driver unit that includes a diaphragm; a housing that accommodates the driver unit, and forms a sealed-type front-face air chamber spatially blocked from an outside except for an opening for sound output on a front face side provided with the diaphragm of the driver unit; and an acoustic tube whose end is directly connected to a first ventilation hole provided in a frame of the driver unit, and that spatially connects a driver-unit rear-face air chamber formed between the frame and the diaphragm with the outside of the driver unit via a tube.

According to the present disclosure, there is provided an acoustic characteristic adjusting method including: accommodating a driver unit that includes a diaphragm within a hosing, and forming a sealed-type front-face air chamber spatially blocked from an outside except for an opening for sound output, between the housing and a front face side provided with the diaphragm of the driver unit; and providing an acoustic tube whose end is directly connected to a first ventilation hole provided in a frame of the driver unit, and that spatially connects a driver-unit rear-face air chamber formed between the frame and the diaphragm with the outside of the driver unit via a tube.

According to the present disclosure, an acoustic tube spatially connecting, via the tube, between the driver-unit rear-face air chamber and the outside of the driver unit is provided, so that a parallel resonance circuit by a capacitor corresponding to the volume of the driver-unit rear-face air chamber and an inductance corresponding to an inductance component to a flow of air in the acoustic tube, is formed in an acoustic equivalent circuit. Therefore, it becomes possible to adjust a sound pressure level characteristic by using anti-resonance in the parallel resonance circuit. The increase in parameters for adjusting the sound pressure level characteristic makes it easy to realize the desired sound pressure level characteristic and makes it possible to further improve an acoustic characteristic.

Advantageous Effects of Invention

As described above, according to the present disclosure, it becomes possible to further improve an acoustic characteristic.

DESCRIPTION OF EMBODIMENTS

Hereinafter, (a) preferred embodiment(s) of the present disclosure will be described in detail with reference to the appended drawings. In this specification and the drawings, elements that have substantially the same function and structure are denoted with the same reference signs, and repeated explanation is omitted.

Note that description will be provided in the following order.

1. Outline of Embodiment of Present Disclosure
2. Configuration of Headphone
3. Acoustic Characteristic Adjusting Method
4. Modification
5. Complement <1. Outline of Embodiment of Present Disclosure>

Figure 1:
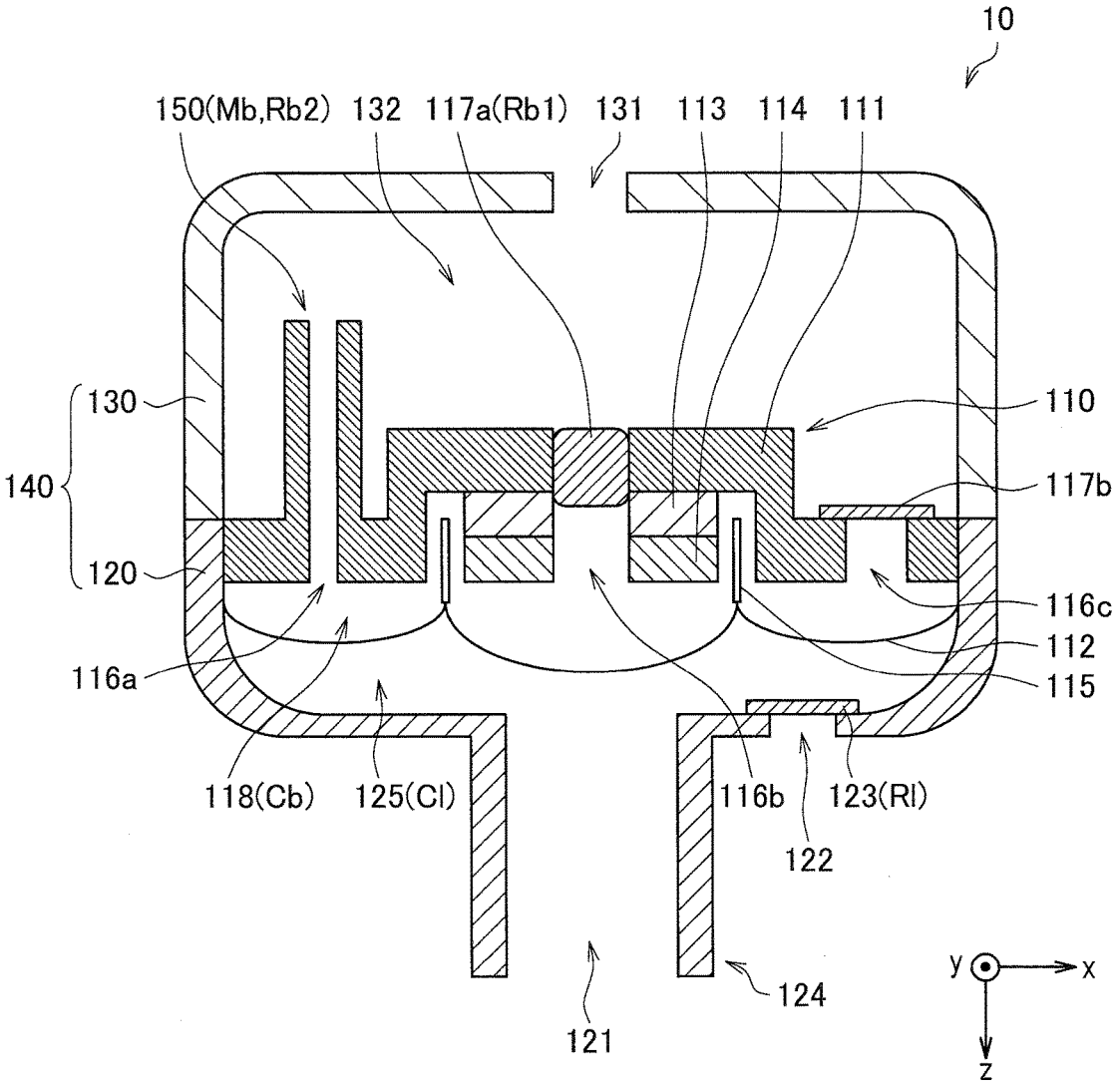
FIG. 1 is a schematic diagram illustrating a schematic configuration of a headphone according to an embodiment of the present disclosure.
Figure 2:
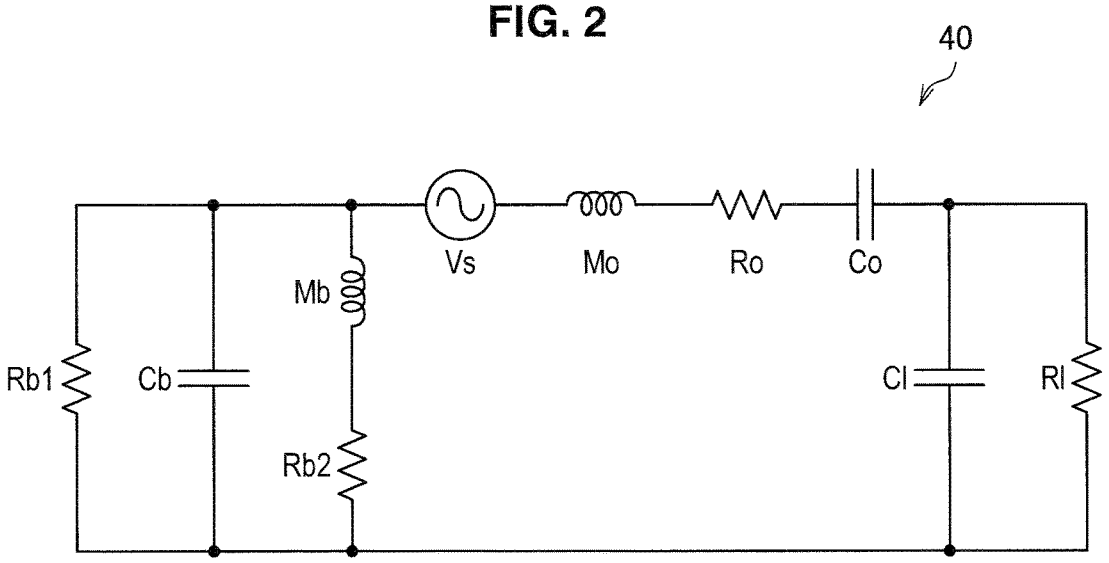
FIG. 2 is a diagram illustrating an acoustic equivalent circuit of the headphone of FIG. 1.
Figure 3:
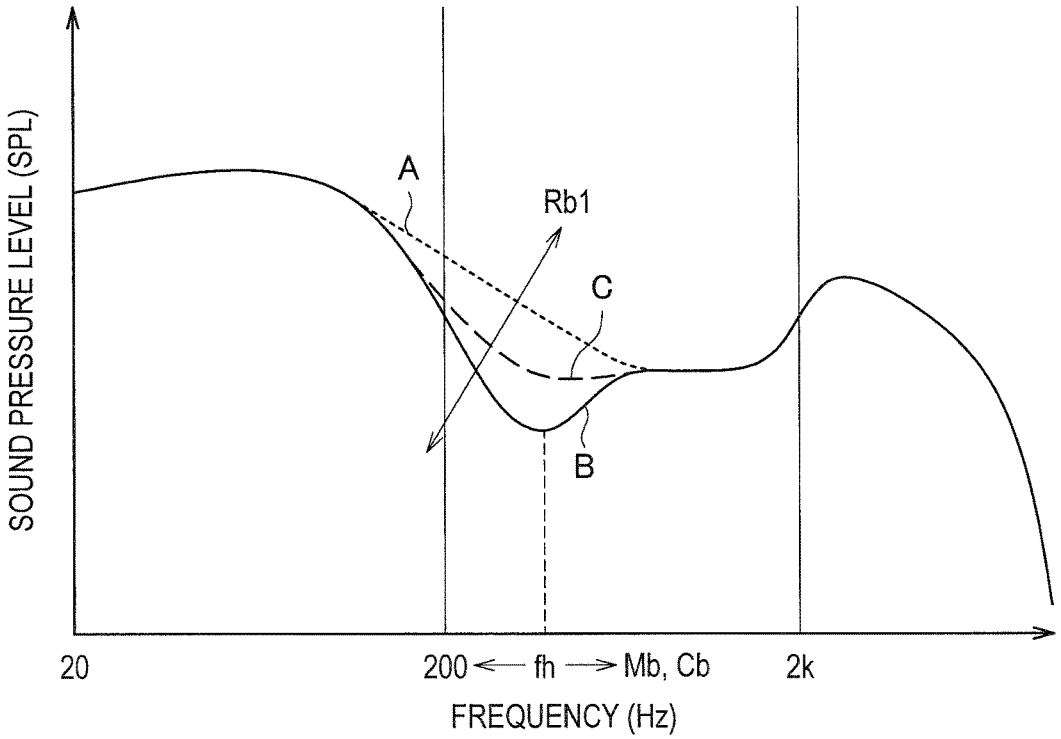
FIG. 3 is a graphic diagram illustrating a sound pressure level characteristic of the headphone according to the present embodiment.

With reference to FIG. 1 to FIG. 3, an outline of an embodiment of the present disclosure will be described. First, with reference to FIG. 1, a schematic configuration of a headphone according to the present embodiment will be described. Next, with reference to FIG. 2, an acoustic equivalent circuit of the headphone according to the present embodiment will be described. Further, with reference to FIG. 3, an acoustic characteristic realized by the present embodiment will be described qualitatively.

First, with reference to FIG. 1, a schematic configuration of a headphone according to an embodiment of the present disclosure will be described. FIG. 1 is a schematic diagram illustrating the schematic configuration of the headphone according to an embodiment of the present disclosure. Referring to FIG. 1, a headphone 10 according to the present embodiment includes a driver unit 110, and a housing 140 accommodating the driver unit 110 therein. FIG. 1 illustrates a cross section passing through a substantial center of the driver unit 110, of the headphone 10. Further, in FIG. 1, for convenience, only primary structural members in the present embodiment, of structural members of the headphone 10 are schematically illustrated. Further, in FIG. 1, in order to indicate a correspondence between the structural members of the headphone 10 and elements of the acoustic equivalent circuit of FIG. 2, symbols of the elements in the acoustic equivalent circuit are added to signs with which the structural members are partially denoted.

The driver unit 110 has a frame 111, a diaphragm 112, a magnet 113, a plate 114, and a voice coil 115. The frame 111 has a substantially disk shape, and on one face side of the disk shape, arranged are the magnet 113, the plate 114, the voice coil 115 and the diaphragm 112. The frame 111 has a projection in its substantial center portion, the projection being projected to a side opposite to the side provided with the magnet 113, the plate 114, the voice coil 115 and the diaphragm 112. The magnet 113, the plate 114, and the voice coil 115 have a cylindrical shape, and are arranged in the inside of the projection substantially concentrically with the frame 111. The magnet 113 is held between the frame 111 and the plate 114. The voice coil 115 is arranged further on the outer circumferential side of the magnet 113 and the plate 114. The diaphragm 112 is provided so as to cover one face of the frame 111, and whose partial region is connected to the voice coil 115. When the voice coil 115 is driven within a magnetic field generated by the magnet 113 according to an audio signal supplied from the outside, for example, by a cable (not shown) or the like, the diaphragm 112 vibrates in its thickness direction. Here, the audio signal is an electric signal on which audio information is superimposed. The diaphragm 112 vibrates according to the audio signal to thereby generate coarseness or denseness in ambient air to generate sound corresponding to the audio signal.

Here, in the following description, a center axis direction in the disk shape of the driver unit 110 is referred to as a z-axis direction. Further, a side provided with the diaphragm 112 when viewed from the driver unit 110 is referred to as a front face side, and a direction of the front face side in the z-axis direction is referred to as a positive direction or a front face direction of the z-axis direction. Further, a side opposite to the front face side is referred to as a rear face side, and a direction of the rear face side in the z-axis direction is referred to as a negative direction or a rear face direction of the z-axis direction. Further, two directions perpendicular to each other within a plane perpendicular to the z-axis direction are referred to as an x-axis direction and a y-axis direction.

In the present embodiment, the voice coil 115 has a cylindrical shape. In the diaphragm 112, a region located on an inner side of the voice coil 115 is referred to also as a dome part, and a region located on an outer side of the voice coil 115 is referred to also as an edge part. Similarly, in the frame 111, a region located on the inner side of the voice coil 115 (a region corresponding to the projection) is referred to also as a dome part, and a region located on the outer side of the voice coil 115 (a region corresponding to a flange part in the outer circumference of the projection) is referred to also as an edge part. In the following description, for convenience, also for a space between the frame 111 and the diaphragm 112 (hereinafter referred to as a driver-unit rear-face air chamber 118), a space formed on the inner side of the voice coil 115 will be referred to as a dome part, and a space formed on the outer side of the voice coil 115 will be referred to as an edge part. In the frame 111 of the driver unit 110, provided are ventilation holes 116*a*, 116*b* and 116*c* penetrating the frame 111 in the z-axis direction, and the driver-unit rear-face air chamber 118 is spatially connected to a space on a rear side of the driver unit 110 (that is, the outside of the driver unit 110) through the ventilation holes 116*a*, 116*b* and 116*c*. In the example shown in FIG. 1, the ventilation hole 116*b* is formed in a substantial center of the frame 111, and spatially connects the dome part of the driver-unit rear-face air chamber 118 with the outside of the driver unit 110. Further, the ventilation holes 116*a* and 116*c* are formed at positions radially shifted from the center of the frame 111 by a predetermined distance, and spatially connect the edge part of the driver-unit rear-face air chamber 118 with the outside of the driver unit 110.

In the ventilation holed 116*b* and 116*c*, ventilation resistance bodies 117*a* and 117*b* are provided so as to block the holes. The ventilation resistance bodies 117*a* and 117*b* are formed of, for example, compressed urethane, a nonwoven fabric, or the like, and acts as a resistance component to a flow of air. However, a material of the ventilation resistance bodies 117*a* and 117*b* is not limited thereto, and another material may be used if it can give predetermined resistance to a flow of air.

To the ventilation hole 116*a*, one end of the acoustic tube 150 is connected. The acoustic tube 150 is a tubular member spatially connecting the driver-unit rear-face air chamber 118 with the outside of the driver unit 110 via the tube. Here, the acoustic tube 150 is formed so as to have such a length and inner cross-sectional area that can be a predetermined inductance component and a predetermined resistance component to a flow of air passing through the acoustic tube 150. Here, the inner cross-sectional area of the acoustic tube 150 is a cross-sectional area of the inside of the tube defined by an inner diameter of the acoustic tube 150. A detailed configuration and shape of the acoustic tube 150 will be described in <2. Configuration of Headphone> described below and <3. Acoustic Characteristic Adjusting Method> described below.

Note that, in the example shown in FIG. 1, the ventilation hole 116*a* to which one end of the acoustic tube 150 is directly connected is provided in a region corresponding to the edge part of the driver-unit rear-face air chamber 118, and the ventilation holes 116*b* and 116*c* provided with the ventilation resistance bodies 117*a* and 117*b* are provided in regions corresponding to the dome part and the edge part of the driver-unit rear-face air chamber 118, respectively, but the positions provided with the ventilation holes 116*a*, 116*b* and 116*c* are not limited thereto. In the present embodiment, for example, one end of the acoustic tube 150 may be directly connected to the ventilation hole 116*b*, and the acoustic tube 150 may spatially connect the dome part of the driver-unit rear-face air chamber 118 with the outside of the driver unit 110 via the tube. The formation position of the ventilation hole to which one end of the acoustic tube 150 is connected, in the frame 111, may be optionally set so that the acoustic tube 150 and the other structural members are efficiently arranged within the housing 140.

Furthermore, the driver unit 110 according to the present embodiment may be a so-called dynamic-type driver unit. Further, the driver unit 110 according to the present embodiment may have a configuration similar to that of an existing typical dynamic-type driver unit except for being provided with the acoustic tube 150. For example, to arrangement positions of the frame 111, the diaphragm 112, the magnet 113, the plate 114 and the voice coil 115 and a driving method of the driver unit 110, arrangement positions and a driving method of these members in the typical dynamic-type driver unit may be applied. However, the driver unit 110 according to the present embodiment is not limited to the typical dynamic-type driver unit, and may be a so-called balanced armature-type driver unit (BA-type driver unit). Even when the acoustic tube 150 is provided in the existing typical dynamic-type driver unit, an effect similar to that of a dynamic-type driver unit to be described later can be obtained.

The housing 140 accommodates the driver unit 110 therein. On a front face side of the driver unit 110, formed is a front-face air chamber 125 formed by the driver unit 110 and the housing 140. Further, on a rear face side of the driver unit 110, formed is a rear-face air chamber 132 formed by the driver unit 110 and the housing 140.

The housing 140 may be configured by a plurality of members. In the example shown in FIG. 1, the housing 140 is formed by joining a front housing 120 covering the front face side of the driver unit 110 and a rear housing 130 covering the rear face side of the driver unit 110 together. Note that the present embodiment is not limited thereto, and the housing 140 may be configured by three or more members.

In a partition wall of the front housing 120, provided are openings 121 and 122 spatially connecting the inside of the housing 140 with the outside. The opening 121 is an opening for outputting sound to the outside (that is, an opening for sound output). Air within the front-face air chamber 125 can be outputted to the outside as sound via the opening 121. In a partial region of the front housing 120, formed is a sound guiding tube 124 as a tubular part provided so as to project toward the outside, and the opening 121 is provided in a tip end part of the sound guiding tube 124. When a user listen to sound, the tip end part of the sound guiding tube 124 is inserted into the external auditory canal of the user. In this manner, in the present embodiment, the headphone 10 may be a so-called canal-type earphone. Note that an earpiece (not shown) for allowing the sound guiding tube 124 to be closely fitted to the inner wall of the external auditory canal of the user may be provided in the outer circumference of the tip end part of the sound guiding tube 124. Further, an equalizer (not shown) as a ventilation resistance body may be provided inside the sound guiding tube 124. It is possible to adjust sound quality such as reducing an output of sound in a specific frequency band by optionally setting a material and a shape of the equalizer.

In the opening 122, a ventilation resistance body 123 is provided so as to block the hole. The ventilation resistance body 123 has a function similar to that of the ventilation resistance bodies 117*a* and 117*b*. In the present embodiment, however, the ventilation resistance body 123 has a material and a shape selected so as to substantially block air. In this manner, in the present embodiment, the front-face air chamber 125 may be spatially blocked from the outside with respect to a flow of air except for the opening 121. In the following description, the front-face air chamber 125 formed so as to be blocked from the outside with respect to a flow of air except for the opening 121 for sound output is referred to also as a sealed-type front-face air chamber 125. Further, the headphone 10 having the sealed-type front-face air chamber 125 is referred to also as the sealed-type headphone 10.

In a partition wall of the rear housing 130, provided is an opening 131 spatially connecting the inside of the housing 140 with the outside. In the present embodiment, the opening 131 is formed so as to have such a size that it can be almost no resistance to a flow of air. In this manner, in the present embodiment, the rear-face air chamber 132 is connected to a space outside the housing 140 via the opening 131 while resistance to a flow of air does not almost exist. Here, in the example shown in FIG. 1, one end of the acoustic tube 150 is directly connected to the ventilation hole 116*a* provided in the frame 111, and the other end is provided within the rear-face air chamber 132. However, as described above, in the present embodiment, the rear-face air chamber 132 is connected to the outside of the housing 140 while resistance to a flow of air does not almost exist. Therefore, in the present embodiment, from a view point of an acoustic characteristic, the acoustic tube 150 can be considered to spatially connect the driver-unit rear-face air chamber 118 with the outside of the housing 140. Therefore, in the present embodiment, the other end of the acoustic tube 150 may be provided within the rear-face air chamber 132, or may be provided outside the housing 140. In any case, it is possible to obtain the same acoustic characteristic.

With reference to FIG. 1, the schematic configuration of the headphone 10 according to the present embodiment has been described above. Next, with reference to FIG. 2, an acoustic equivalent circuit of the headphone 10 of FIG. 1 will be described. FIG. 2 is a diagram illustrating the acoustic equivalent circuit of the headphone 10 of FIG. 1.

Here, the acoustic equivalent circuit is one obtained by replacing elements of a mechanical system and an acoustic system with elements of an electric circuit. In the acoustic equivalent circuit, its voltage corresponds to sound pressure in the acoustic system and its current corresponds to particle velocity of air (that is, a flow of air) in the acoustic system. Therefore, it is possible to analyze sound pressure of outputted sound in the headphone 10 by analyzing a voltage in the acoustic equivalent circuit of the headphone 10. Here, a value obtained by expressing a ratio of sound pressure to a reference value (for example, a minimum audible sound pressure value of a human) in a decibel unit is referred to as a sound pressure level (SPL), which is one indicator for evaluating an acoustic characteristic. It can be said that adjusting a sound pressure level characteristic is, that is, adjusting an acoustic characteristic. It is possible to evaluate an acoustic characteristic of the headphone 10 by calculating a sound pressure level from the acoustic equivalent circuit of the headphone 10.

With reference to FIG. 2, in an acoustic equivalent circuit 40, a signal source Vs, an inductance Mo, a resistor Ro, and a capacitor Co are arranged in series. The signal source Vs, the inductance Mo, the resistor Ro, and the capacitor Co are elements corresponding to elements of the mechanical system of the driver unit 110. Specifically, the signal source Vs is an element corresponding to vibratory force when the diaphragm 112 is vibrated by the driver unit 110, and is a power supply element for generating electromotive force in the acoustic equivalent circuit 40. Further, the inductance Mo, the resistor Ro, and the capacitor Co are elements corresponding to mass, mechanical resistance, and compliance, respectively.

Furthermore, in the acoustic equivalent circuit 40, a resistor R1 and a capacitor C1 are arranged in parallel. Here, the resistor R1 and the capacitor C1 are elements corresponding to a flow of air in the front-face air chamber 125. Specifically, the R1 corresponds to a resistance component by the ventilation resistance body 123 provided in the opening 122 of the front-face air chamber 125. As described above, in the present embodiment, since the front-face air chamber 125 is a sealed type, the resistor R1 can be considered to have a sufficiently large value. Further, the capacitor C1 corresponds to a volume of the front-face air chamber 125.

Furthermore, in the acoustic equivalent value 40, a resistor Rb1, a capacitor Cb, an inductance Mb and a resistor Rb2 are arranged in parallel. Here, the resistor Rb1, the capacitor Cb, the inductance Mb and the resistor Rb2 are elements corresponding to a flow of air in the rear-face air chamber 132. Specifically, the resistor Rb1 corresponds to a resistance component by the ventilation resistance bodies 117*a* and 117 *b* provided in the ventilation holes 116*b* and 116*c* spatially connecting the driver-unit rear-face air chamber 118 with the rear-face air chamber 132. In the example shown in FIG. 1, the two ventilation resistance bodies 117*a* and 117*b* are provided in the two ventilation holes 116*b* and 116*c*, respectively, but in the acoustic equivalent circuit 40, a resistance component by the two ventilation resistance bodies 117*a* and 117*b* is expressed by the one resistor Rb1. Further, the capacitor Cb corresponds to a volume of the driver-unit rear-face air chamber 118. Further, the inductance Mb and the resistor Rb2 correspond to an inductance component and a resistance component in the acoustic tube 150, respectively. Here, as described later with reference to FIG. 3, in the present embodiment, the acoustic characteristic of the headphone 10 is adjusted by changing a value of the resistor Rb1, the capacitor Cb and the inductance Mb. In the following, the resistor Rb1, the capacitor Cb and the inductance Mb are referred to also as an acoustic resistor, an acoustic capacitor and an acoustic inductance, respectively.

Here, paying attention to the capacitor Cb and the inductance Mb, in the acoustic equivalent circuit 40, it can be considered that a parallel resonance circuit generating anti-resonance at a predetermined resonance frequency is formed by the capacitor Cb and the inductance Mb. In the present embodiment, it is possible to adjust a sound pressure level in a predetermined frequency band by generating anti-resonance by the capacitor Cb and the inductance Mb.

With reference to FIG. 3, the adjustment of the sound pressure level using the anti-resonance by the capacitor Cb and the inductance Mb will be described in detail. FIG. 3 is a graphic diagram illustrating a sound pressure level characteristic of the headphone 10 according to the present embodiment. In FIG. 3, a frequency is indicated in the horizontal axis, and a sound pressure level is indicated in the vertical axis, and a sound pressure level characteristic in the headphone 10 obtained from an analysis result of the acoustic equivalent circuit 40 of FIG. 2 is plotted.

First, with reference to FIG. 3, a desired acoustic characteristic in the present embodiment will be described. In the following description, for convenience, a frequency band of 200 Hz or less is referred to as a low range, a frequency band of 200 Hz to 2000 Hz is referred to as a middle range, and a frequency band of 2000 Hz or more is referred to as a high range. When a frequency band is divided in this manner, for example, a human voice belongs to the middle range, and base sound lower than that belongs to the low range.

Here, as a typical existing technology, there has been disclosed a technique for improving an acoustic characteristic by making a sound pressure level in the low range greater than a sound pressure level in the middle range. For example, it is known that a headphone having a sealed-type front-face air chamber (for example, the canal-type earphone described in Patent Literature 1 described above) can output sound while maintaining predetermined sound pressure to a lower frequency band. In this manner, it becomes possible to realize a sound pressure level characteristic in which a sound pressure level in the low range is maintained at a higher value than a sound pressure level in the middle range, by using the headphone having the sealed-type front-face air chamber. Such a sound pressure level characteristic in the existing headphone can be shown, for example, by the dotted curve A shown in FIG. 3.

Meanwhile, when the sound pressure significantly changes in a frequency band of the middle range including a human voice, the human voice sounds like boxy sound for a user listening to the sound. Therefore, it is desirable that the sound pressure level is as flat as possible in the middle range. In this manner, it is thought that as one of ideal acoustic characteristics it has a sound pressure characteristic in which a sound pressure level is reduced in a stepwise manner from the low range to the middle range (hereinafter merely referred to as a "stepwise sound pressure level characteristic). However, as shown in the curve A, in the sound pressure level characteristic of the existing headphone, the sound pressure is gently reduced at a predetermined inclination from the low range to the middle range. Therefore, the existing headphone has had a risk that high sound quality for a human voice cannot be realized, and has had room to improve the sound pressure level in the middle range.

Here, in the existing headphone, a sound pressure level in a predetermined frequency band can be determined at least based on a value of ventilation resistance between the driver-unit rear-face air chamber and a space on a rear face side of the driver unit (that is, corresponding to the resistance components by the ventilation resistance bodies 117*a* and 117*b* of FIG. 1 and the resistor Rb1 of FIG. 2 in the present embodiment). Specifically, it is possible to adjust a value of the sound pressure level from the low range to the middle range by changing a value of the resistor Rb1 corresponding to the ventilation resistance. Therefore, it is possible to adjust the sound pressure level in the middle range to improve a sound characteristic by changing a value of the resistor Rb1. However, as shown by the arrow in FIG. 3, even when a value of the resistor Rb1 is changed, a value of the sound pressure level goes up and down while the inclination in the curve A remains. As described above, in the existing headphone, it has been difficult to obtain a stepwise sound pressure level characteristic.

Meanwhile, in the present embodiment, the parallel resonance circuit for generating anti-resonance by the capacitor Cb and the inductance Mb is formed by providing the acoustic tube 150. The anti-resonance in the acoustic equivalent circuit acts so as to form a dip in a sound pressure level in the sound pressure level curve shown in FIG. 3. For example, with reference to FIG. 3, the curve B having the dip of the sound pressure level in the frequency band of around 200 (Hz) to 400 (Hz) is shown by the solid line. The dip corresponds to the anti-resonance generated by the capacitor Cb and the inductance Mb. Here, a resonance frequency fh of the anti-resonance is determined at least based on a value of the capacitor Cb and the inductance Mb. In this manner, in the present embodiment, it becomes possible to adjust a frequency band where the resonance frequency fh is included, that is, a frequency band where the dip of the sound pressure level is formed, by adjusting a value of the capacitor Cb and the inductance Mb.

Furthermore, as described above, the driver unit 110 according to the present embodiment may have a configuration similar to that of the existing typical dynamic-type driver unit except for being provided with the acoustic tube 150. Therefore, also in the present embodiment, similarly to the existing headphone, a sound pressure level in a predetermined frequency band can be determined at least based on a value of the resistor Rb1. Specifically, in the present embodiment, it is possible to adjust a value of the sound pressure level from the low range to the middle range by changing a value of the resistor Rb1. Therefore, by adjusting a value of the capacitor Cb and the inductance Mb so that the resonance frequency fh of the anti-resonance is located between the low range and the middle range, a value of the sound pressure level from the low range to the middle range can be a value obtained by adding a change in value by the resistor Rb1 and a change in value by the dip formed by the anti-resonance together. Therefore, a step of the sound pressure level having an inclination greater than the inclination indicated in the curve A can be formed in the frequency band where the resonance frequency fh is located, that is, the frequency band where the dip is formed.

In this manner, in the present embodiment, the sound pressure level of the headphone 10 in the predetermined frequency band can be determined at least based on a value of the capacitor Cb, a value of the inductance Mb, and a value of the resistor Rb1. Specifically, the sound pressure level from the low range to the middle range can be adjusted by the capacitor Cb, the inductance Mb and the resistor Rb1. Further, in the present embodiment, since the front-face air chamber 125 is a sealed type, the sound pressure level characteristic in which the sound pressure level in the low range is maintained at a value higher than the sound pressure level in the middle range, can be realized. Therefore, it is possible to obtain, for example, the stepwise sound pressure level characteristic described above, by optionally adjusting a value of the capacitor Cb, the inductance Mb and the resistor Rb1. Further, in the stepwise sound pressure level characteristic, a sound pressure level difference between the low range and the middle range, and a frequency band where a step is located when the sound pressure level is reduced in a stepwise manner, can be adjusted by the capacitor Cb, the inductance Mb and the resistor Rb1. Therefore, for example, a sharp acoustic characteristic having a large level difference between the low range and the middle range can be realized.

In FIG. 3, an example of the stepwise sound pressure level characteristic obtained in the present embodiment is shown by the curve C of the broken line. In the sound pressure level characteristic shown in the curve C, for example, a value of the capacitor Cb and the inductance Mb can be optionally adjusted so that the resonance frequency fh is located between 200 (Hz) and 400 (Hz). Further, while the resonance frequency fh is located between 200 (Hz) and 400 (Hz), a value of the resistor Rb1 can be optionally adjusted so that the sound pressure level is reduced in a stepwise manner from the low range to the middle range, and the sound pressure level is nearly flat in the middle range.

Here, as described above, the capacitor Cb corresponds to the volume of the driver-unit rear-face air chamber 118, and its value can be determined by the configuration of the frame 111 and the diaphragm 112 in the driver unit 110. The inductance Mb corresponds to the inductance component of the acoustic tube 150, and its value depends on the shape of the acoustic tube 150. The smaller the inner cross-sectional area of the acoustic tube 150, the longer the length, the greater the value of the inductance Mb. Further, the resistor Rb1 corresponds to the resistance components by the ventilation resistance bodies 117*a* and 117*b* provided in the ventilation holes 116*b* and 116*c* spatially connecting the driver-unit rear-face air chamber 118 with the rear-face air chamber 132, and its value depends on the material and the shape of the ventilation resistance bodies 117*a* and 117*b*. For example, the denser the particles in the material of the ventilation resistance bodies 117*a* and 117*b*, the longer the length of the ventilation resistance bodies 117*a* and 117*b* in a flowing direction of air (the z-axis direction in the example of FIG. 1), the smaller the cross-sectional area of the ventilation resistance bodies 117*a* and 117*b*, the greater the value of the resistor Rb1. In this manner, in the present embodiment, it is possible to change a value of the inductance Mb and the resistor Rb1 and realize a desired sound pressure level characteristic by changing the configuration of the frame 111 and the diaphragm 112 in the driver unit 110, the shape of the acoustic tube 150, and the material and the shape of the ventilation resistance bodies 117*a* and 117*b*.

In this manner, in the present embodiment, the desired sound pressure level characteristic is realized by providing the acoustic tube 150, and optionally setting a value of the capacitor Cb, the inductance Mb and the resistor Rb1. Therefore, it becomes possible to adjust and improve the acoustic characteristic.

<2. Configuration of Headphone>

Figure 4:
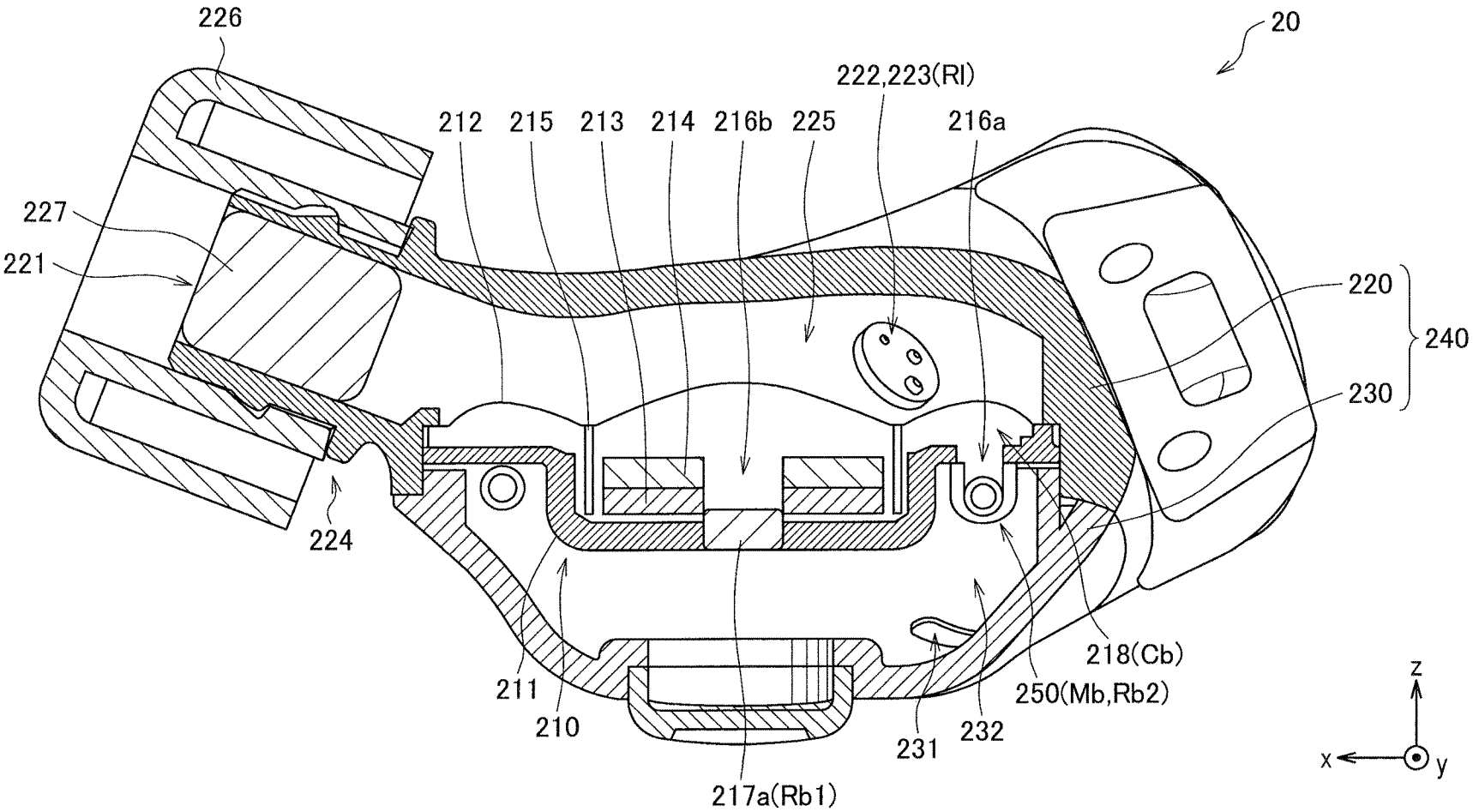
FIG. 4 is a cross-sectional diagram illustrating a configuration of the headphone according to an embodiment of the present disclosure.

Next, with reference to FIG. 4, a configuration of the headphone according to an embodiment of the present disclosure will be described in more detail. FIG. 4 is a cross-sectional diagram illustrating the configuration of the headphone according to an embodiment of the present disclosure. With reference to FIG. 4, a headphone 20 according to the present embodiment includes a driver unit 210, and a housing 240 accommodating the driver unit 210 therein. FIG. 4 illustrates a cross section passing through the substantial center of the driver unit 210, of the headphone 20. Note that the structural members shown in FIG. 4 are simplified for description of the present embodiment, and the headphone 20 may further include structural members not shown, such as a cable for supplying an audio signal to the driver unit 210. Since the structural members not shown can be ones already known as structural members in the existing typical headphone, the detailed description is omitted.

Here, the headphone 20 shown in FIG. 4 corresponds to the headphone 10 described with reference to FIG. 1. In the description for each structural member of the headphone 20, a correspondence relationship with each structural member of the headphone 10 of FIG. 1 will be described. Further, since the corresponding structural members have functions similar to each other, the detailed descriptions for ones corresponding to the structural members already described with reference to FIG. 1 in the structural members of the headphone 20 are omitted. Further, the acoustic equivalent circuit of the headphone 20 can be also one similar to the acoustic equivalent circuit 40 of FIG. 2. Therefore, similarly to FIG. 1, symbols of the elements in the acoustic equivalent circuit 40 are added to signs with which the structural members of the headphone 20 are partially denoted.

The driver unit 210 has a frame 211, a diaphragm 212, a magnet 213, a plate 214, and a voice coil 215. The driver unit 210 corresponds to the driver unit 110 of FIG. 1. Further, the frame 211, the diaphragm 212, the magnet 213, the plate 214, and the voice coil 215 correspond to the frame 111, the diaphragm 112, the magnet 113, the plate 114, and the voice coil 115 of FIG. 1. A driver-unit rear-face air chamber 218 is formed between the driver unit 210 and the diaphragm 212. An element corresponding to electromotive force when the diaphragm 212 is vibrated corresponds to the signal source Vs in the acoustic equivalent circuit 40. Further, mass, mechanical resistance and compliance in the driver unit 210 corresponds to the inductance Mo, the resistance Ro and the capacitor Co in the acoustic equivalent circuit 40, respectively. Further, the volume of the driver-unit rear-face air chamber 218 corresponds to the capacitor Cb in the acoustic equivalent circuit 40.

In the frame 211 of the driver unit 210, provided are ventilation holes 216*a* and 216*b* penetrating the frame 211 in the z-axis direction. The ventilation holes 216*a* and 216*b* correspond to the ventilation holes 116*a* and 116*b* shown in FIG. 1. The ventilation hole 216*a* is formed at a position radially shifted from the center of the frame 211 by a predetermined distance, and spatially connects the edge part of the driver-unit rear-face air chamber 218 with the outside of the driver unit 210. Further, the ventilation hole 216*b* is formed at the substantial center of the frame 211, and spatially connects the dome part of the driver-unit rear-face air chamber 218 with the outside of the driver unit 210.

In the ventilation hole 216*b*, a ventilation resistance body 217*a* is provided so as to block the hole. The ventilation resistance body 217*a* corresponds to the ventilation resistance body 117*a* of FIG. 1. A resistance component to a flow of air, of the ventilation resistance body 217*a* corresponds to the resistor Rb1 in the acoustic equivalent circuit 40.

Here, a material and a shape of the ventilation resistance body 217*a* may be optionally set so as to obtain the desired sound pressure level characteristic, for example, in consideration of the sound pressure level characteristic as shown in FIG. 3. More specifically, as described with reference to FIG. 3, a material and a shape of the ventilation resistance body 217*a* can be optionally set so that a value of the resistor Rb1 for obtaining the stepwise sound pressure level characteristic can be realized.

To the ventilation hole 216*a*, one end of the acoustic tube 259 is connected. An acoustic tube 250 is a member corresponding to the acoustic tube 150 of FIG. 1. The acoustic tube 250 is a tubular member spatially connecting the driver-unit rear-face air chamber 218 with the outside of the driver unit 210 via the tube. An inductance component and a resistance component to a flow of air in the acoustic tube 250 correspond to the inductance Mb and the resistor Rb2 in the acoustic equivalent circuit 40, respectively.

Figure 5:
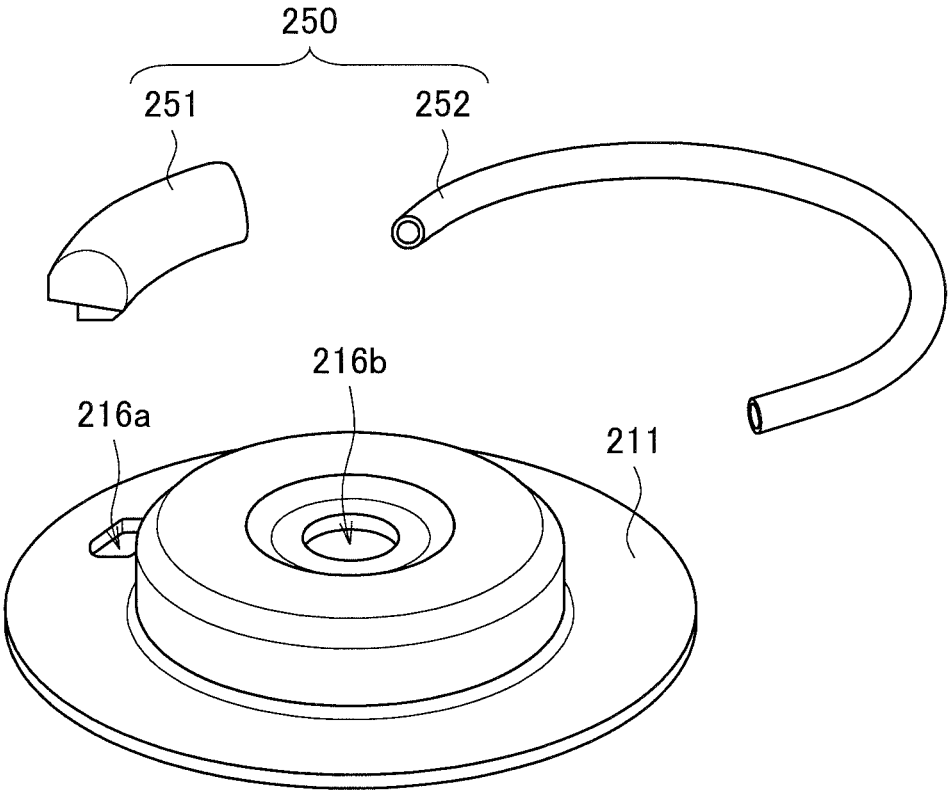
FIG. 5 is an exploded perspective diagram of a driver unit and an acoustic tube of FIG. 4.

Here, with reference to FIG. 5, a configuration of the acoustic tube 250 in the headphone 20 will be described in more detail. FIG. 5 is an exploded perspective diagram of the driver unit 210 and the acoustic tube 250 of FIG. 4. In FIG. 5, for convenience, only the frame 211 of the structural members of the driver unit 210 is shown, and a state where the acoustic tube 250 is removed from the frame 211 is shown.

With reference to FIG. 5, the acoustic tube 250 includes an attachment 251 and a tube 252. The attachment 251 connects the ventilation hole 216*a* with one end of the tube 252, and is a connection member for spatially connecting the driver-unit rear-face air chamber 218 with the inside of the tube 252. In the attachment 251, in a region corresponding to the ventilation hole 216*a*, and a region having one end of the tube 252 attached thereto, openings are provided, respectively, and these openings are spatially connected within the attachment 251. Further, a shape and a formation position of these openings are designed so as to prevent air from leaking to a space except for the ventilation hole 216*a* and the inside of the tube 252. In this manner, the use of the attachment 251 allows the ventilation hole 216*a* to be spatially connected to the opening in one end of the tube 252 while leakage of air to the outside is substantially eliminated, allowing air within the driver-unit rear-face air chamber 218 to be securely flown into the tube 252 (that is, into the acoustic tube 250).

The tube 252 is a tubular member formed of, for example, a substance having flexibility. The tube 252 is arranged along the circumferential direction of the frame 211 having a disk shape, for example, as shown in FIG. 5. By arranging the tube 252 along the circumferential direction of the frame 211, it becomes possible to arrange the tube 252 in a smaller space, and to provide the acoustic tube 250 without deforming a shape of the housing 240 or enlarging the housing 240.

Here, when the inductance component and the resistance component to a flow of air in the inside of the attachment 251 can be ignored, a length and an inner cross-sectional area of the tube 252 correspond to a length and an inner cross-sectional area of the acoustic tube 250. The length and the inner cross-sectional area of the tube 252 may be optionally set so as to obtain the desired sound pressure level characteristic in consideration of the sound pressure level characteristic, for example, as shown in FIG. 3. More specifically, as described with reference to FIG. 3, the length and the inner cross-sectional area of the tube 252 can be optionally set so as to realize a value of such a capacitor Cb and inductance Mb that the resonance frequency where anti-resonance is generated is located in the desired frequency band. Note that, when the inductance component and the resistance component to a flow of air in the inside of the attachment 251 cannot be ignored, the length and the inner cross-sectional area of the tube 252 can be optionally set so that the capacitor Cb and the inductance Mb in a structure where the attachment 251 is connected to the tube 252 are the desired value. A detailed method for adjusting the length and the inner cross-sectional area of the acoustic tube 250 will be described in detail in <3. Acoustic Characteristic Adjusting Method> described below.

In this manner, in the present embodiment, the acoustic tube 250 is formed with a relatively simple configuration of the attachment 251 and the tube 252. Here, as described with reference to FIG. 1, the driver unit 210 according to the present embodiment may have a configuration similar to that of the existing typical dynamic-type driver unit except for being provided with the acoustic tube 250. Therefore, in the present embodiment, it is possible to manufacture the acoustic tube 250 according to the present embodiment only by forming the ventilation hole 216*a* in the frame of the existing typical dynamic-type driver unit, and mounting the attachment 251 and the tube 252. Therefore, the improvement in the acoustic characteristic is realized at lower costs. Note that, in the example shown in FIG. 5, only the one ventilation hole 216*a* is provided in the frame 211, but the present embodiment is not limited thereto. In the present embodiment, a plurality of ventilation holes 216*a* may be provided in the frame 211, and the opening of the attachment 251 may be formed so as to cover the plurality of ventilation holes 216*a*. When the opening of the attachment 251 is formed so as to cover the plurality of ventilation holes 216*a*, the ventilation between the driver-unit rear-face air chamber 218 and the acoustic tube 250 will be more securely performed.

Referring to FIG. 4 again, the description of the configuration of the headphone 20 will be continued. The housing 240 accommodates the driver unit 210 therein. The housing 240 corresponds to the housing 140 shown in FIG. 1. On a front face side of the driver unit 210, formed is a front-face air chamber 225 as a space surrounded by the driver unit 210 and the housing 240. Further, on a rear face side of the driver unit 210, formed is a rear-face air chamber 232 as a space surrounded by the driver unit 210 and the housing 240. A volume of the front-face air chamber 225 corresponds to the capacitor C1 in the acoustic equivalent circuit 40.

The housing 240 may be formed of a plurality of members. In the example shown in FIG. 4, the housing 240 is formed by joining a front housing 220 covering the front face side of the driver unit 210 and a rear housing 230 covering the rear face side of the driver unit 210 together. The front housing 220 and the rear housing 230 correspond to the front housing 120 and the rear housing 130 shown in FIG. 1.

In a partition wall of the front housing 220, provided are openings 221 and 222 spatially connecting the inside of the housing 240 with the outside. The openings 221 and 222 correspond to the openings 121 and 122 of FIG. 1. The opening 121 is an opening for outputting sound to the outside. In a partial region of the front housing 220, formed is a sound guiding tube 224 as a tubular part provided so as to project toward the outside, and the opening 221 is provided in a tip end part of the sound guiding tube 224. The sound guiding tube 224 corresponds to the sound guiding tube 124 of FIG. 1. In the outer circumference of the tip end part of the sound guiding tube 224, provided is an earpiece 226 for allowing the sound guiding tube 124 to be closely fitted to the inner wall of the external auditory canal of a user. When the user listen to sound, the tip end part of the sound guiding tube 124 including the earpiece 226 is inserted into the external auditory canal of the user. In this manner, in the present embodiment, the headphone 20 may be a so-called canal-type earphone. Further, an equalizer 227 as a ventilation resistance body is provided inside the sound guiding tube 224. It is possible to adjust sound quality such as reducing a component in a specific frequency band for sound to be outputted, by optionally setting a material and a shape of the equalizer.

In the opening 222, a ventilation resistance body 223 is provided so as to block the hole. The ventilation resistance body 223 corresponds to the ventilation resistance body 123 of FIG. 1. That is, also in the headphone 20, similarly to the headphone 10, a material and a shape of the ventilation resistance body 223 are selected so as to substantially block air. In this manner, in the present embodiment, the front-face air chamber 225 may be a sealed-type air chamber where it is spatially blocked from the outside except for the opening 221. A resistance component to a flow of air of the ventilation resistance body 223 corresponds to the resistor R1 in the acoustic equivalent circuit 40.

In a partition wall of the rear housing 230, provided is an opening 231 spatially connecting the inside of the housing 240 with the outside. The opening 231 corresponds to the opening 131 of FIG. 1. That is, the opening 231 is formed so as to have such a size that it can be almost no resistance to a flow of air. In this manner, in the present embodiment, the rear-face air chamber 232 is connected to a space outside the housing 240 via the opening 231 while resistance to a flow of air does not almost exist. Therefore, similarly to the acoustic tube 150 of FIG. 1, the other end of the acoustic tube 250 according to the present embodiment may be also provided within the rear-face air chamber 232, or may be provided outside the housing 240. In any case, it is possible to obtain the same acoustic characteristic.

With reference to FIG. 4, the configuration of the headphone 20 according to an embodiment of the present disclosure has been described above in more detail.

<3. Method for Designing Acoustic Tube and Driver Unit>

Next, taking the headphone 20 as an example, a specific method for designing the acoustic tube 250 and the driver unit 210 according to the present embodiment will be described. As described with reference to FIG. 3, in order to obtain the ideal stepwise sound pressure level characteristic, it is preferable that the resonance frequency fh of the anti-resonance generated by the capacitor Cb and the inductance Mb is included in the frequency band of 200 (Hz) to 400 (Hz). Here, the inductance Mb depends on the length and the inner cross-sectional area of the acoustic tube 250, and the capacitor Cb depends on the volume of the driver-unit rear-face air chamber 218. There will be described below a method for designing the length and the inner cross-sectional area of the acoustic tube 250, and the volume of the driver-unit rear-face air chamber 218 so that the resonance frequency fh of the anti-resonance is included in the frequency band of 200 (Hz) to 400 (Hz).

The resonance frequency fh (Hz) of the anti-resonance by the inductance Mb and the capacitor Cb is expressed by Formula (1) described below.

[Math. 1]

$$fh = \frac{1}{2\pi\sqrt{Mb \times Cb}} \quad (1)$$

Further, when the length of the acoustic tube 250 is L (m) and the inner cross-sectional area thereof is S ($m^2$), the inductance Mb is expressed by Formula (2) described below.

[Math. 2]

$$Mb = \rho \times \frac{L}{S} \quad (2)$$

Here, ρ ($kg/m^3$) is air density. Also, when the volume of the driver-unit rear-face air chamber 218 is V ($m^3$), the capacitor Cb is expressed by Formula (3) described below. Note that c (m/s) is sound velocity.

[Math. 3]

$$Cb = \frac{V}{\rho c^2} \quad (3)$$

Figure 6:
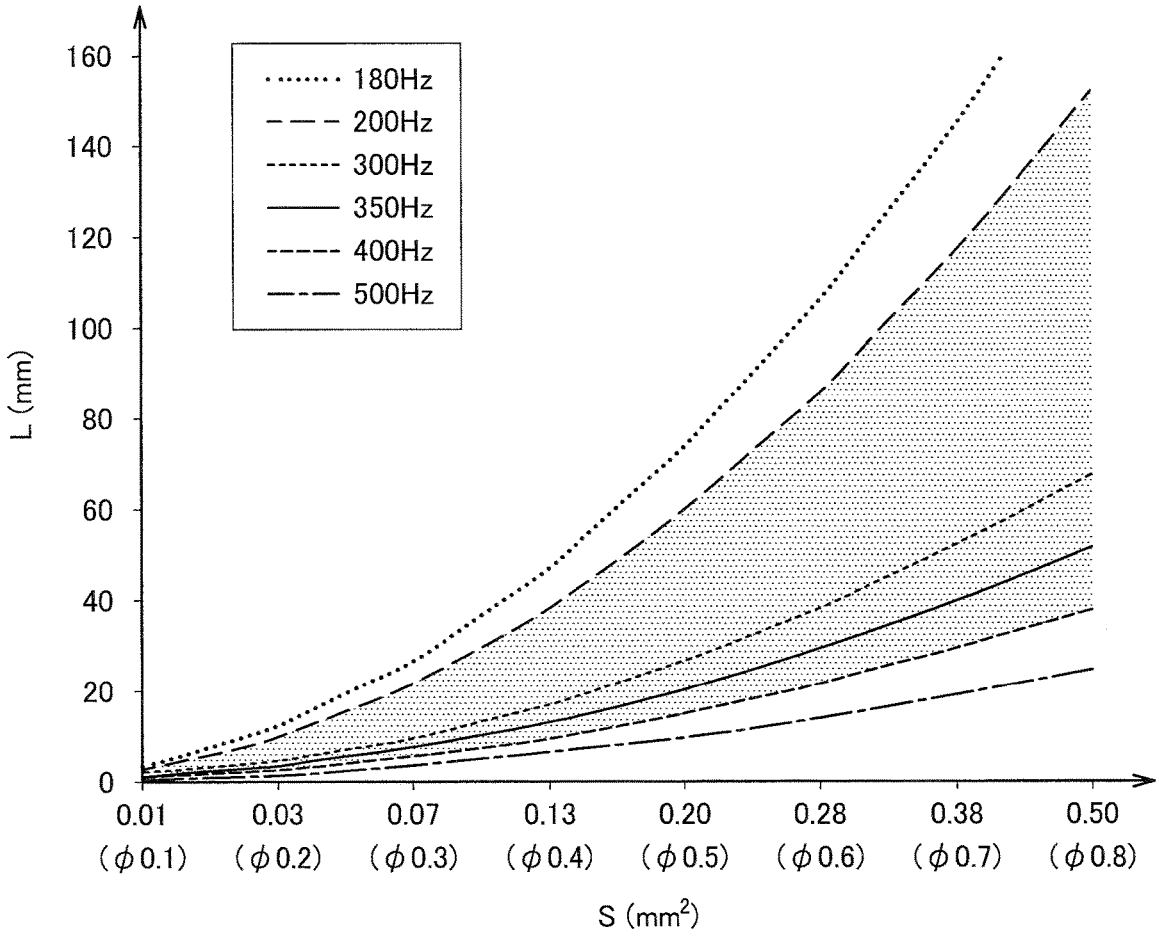
FIG. 6 is a graphic diagram illustrating a relationship between a resonance frequency fh of anti-resonance, and a length L of the acoustic tube, an inner cross-sectional area S of the acoustic tube and a volume V of a driver-unit rear-face air chamber.
Figure 7:
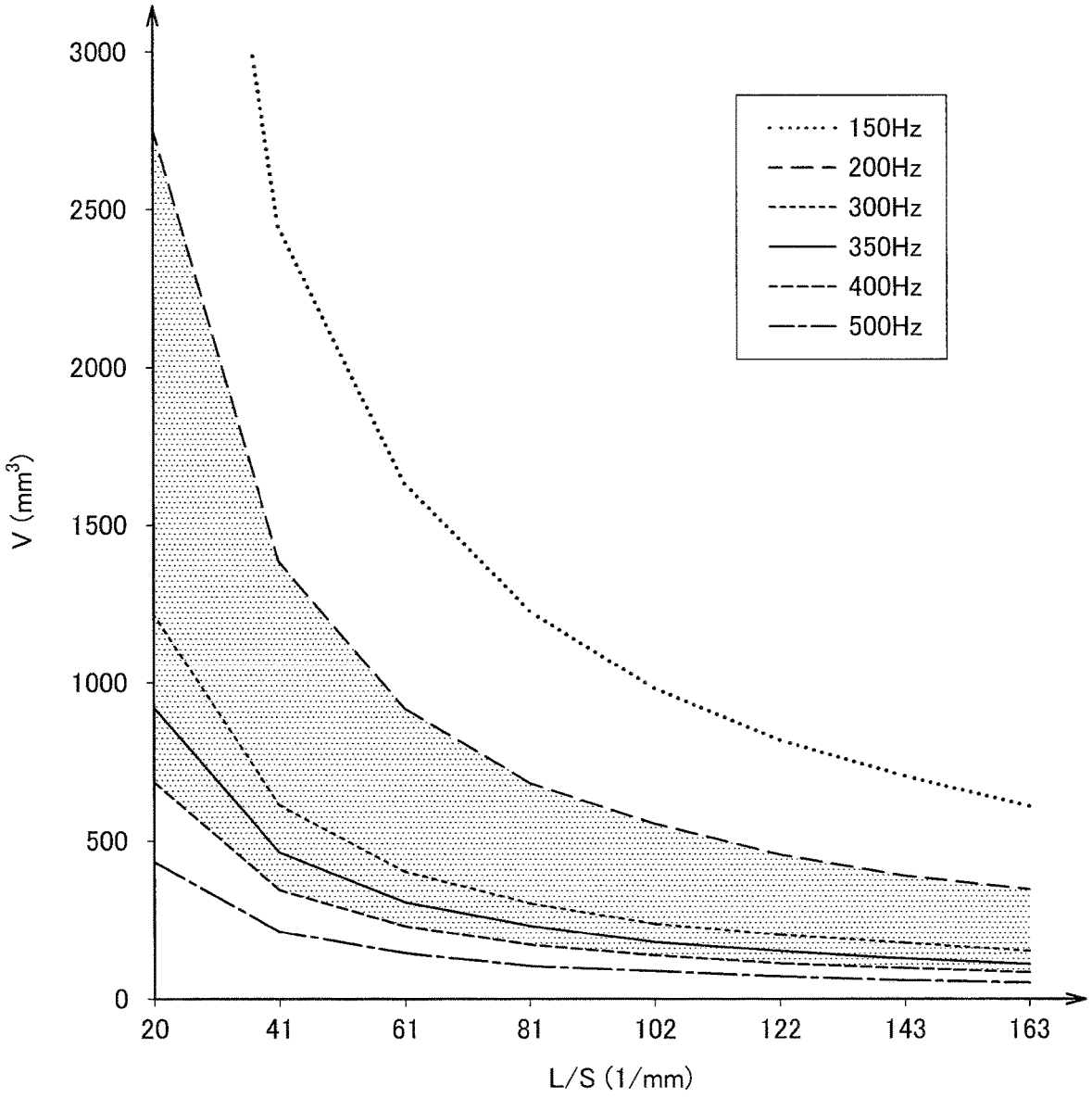
FIG. 7 is a graphic diagram illustrating a relationship between a resonance frequency fh of anti-resonance, and a length L of the acoustic tube, an inner cross-sectional area S of the acoustic tube and a volume V of a driver-unit rear-face air chamber.

It is possible to obtain a condition for the length L and the inner cross-sectional area S of the acoustic tube 250, and the volume V of the driver-unit rear-face air chamber 218 so that the resonance frequency fh of the anti-resonance can be included in the frequency band of 200 (Hz) to 400 (Hz), by using Formulas (1) to (3) described above. The results are shown in FIG. 6 and FIG. 7. FIG. 6 and FIG. 7 are a graphic diagram illustrating a relationship between the resonance frequency fh of the anti-resonance, and the length L of the acoustic tube 250, the inner cross-sectional area S of the acoustic tube 250 and the volume V of the driver-unit rear-face air chamber 218.

With reference to FIG. 6, the inner cross-sectional area S ($mm^2$) of the acoustic tube 250 is indicated in the horizontal axis, and the length L (mm) of the acoustic tube 250 is indicated in the vertical axis, and a relationship between the length L (mm) and the inner cross-sectional area S ($mm^2$) for obtaining the resonance frequency fh=180, 200, 300, 400 and 500 (Hz) is plotted. Note that, in the graph of FIG. 6, V=180 ($mm^3$) is fixed. V=180 ($mm^3$) corresponds to, for example, a case where the diameter of the frame 211 of the driver unit 210 is 16 (mm).

In FIG. 6, the range where the resonance frequency fh of the anti-resonance is included in 200 (Hz) to 400 (Hz) is indicated by hatching. The result of FIG. 6 shows that the acoustic tube 250 should be designed so that the length L (mm) and the inner cross-sectional area S ($mm^2$) of the acoustic tube 250 are included in the hatching region, in order to be set so that the resonance frequency fh is included in 200 (Hz) to 400 (Hz) in a case of V=180 ($mm^3$). Conversely, when the acoustic tube 250 is designed so that the length L (mm) and the inner cross-sectional area S ($mm^2$) of the acoustic tube 250 are included in the hatching region, the resonance frequency fh is included in 200 (Hz) to 400 (Hz), and the stepwise sound pressure level characteristic can be obtained. For example, when the acoustic tube 250 having the length L (mm) of 20 (mm) and the inner cross-sectional area S ($mm^2$) of 0.20 ($mm^2$) is configured, it is possible to generate the anti-resonance having the resonance frequency fh of around 350 (Hz) to obtain the stepwise sound pressure level characteristic.

With reference to FIG. 7, a ratio L/S (1/mm) of the length L (mm) of the acoustic tube 250 to the inner cross-sectional area S ($mm^2$) thereof is indicated in the horizontal axis, and the volume V ($mm^3$) of the driver-unit rear-face air chamber 218 is indicated in the vertical axis, and a relationship between the L/S (1/mm) and the volume ($mm^3$) for obtaining the resonance frequency fh=180, 200, 300, 400 and 500 (Hz) is plotted. In FIG. 7, similarly to FIG. 6, the range where the resonance frequency fh of the anti-resonance is included in 200 (Hz) to 400 (Hz) is indicated by hatching. The result of FIG. 7 shows that the acoustic tube 250 and the driver unit 210 should be designed so that the ratio L/S (1/mm) of the length L (mm) of the acoustic tube 250 to the inner cross-sectional area S ($mm^2$), and the volume V ($mm^3$) of the driver-unit rear-face air chamber 218 are included in the hatching region, in order to be set so that the resonance frequency fh is included in 200 (Hz) to 400 (Hz). Conversely, when the acoustic tube 250 and the driver unit 210 are designed so that the ratio L/S (1/mm) of the length L (mm) of the acoustic tube 250 to the inner cross-sectional area S ($mm^2$), and the volume V ($mm^3$) of the driver-unit rear-face air chamber 218 are included in the hatching region, the resonance frequency fh is included in 200 (Hz) to 400 (Hz), and the stepwise sound pressure level characteristic can be obtained. For example, when the acoustic tube 250 having the volume V ($mm^3$) of 180 ($mm^3$), and the ratio L/S (1/mm) of the length L (mm) of the acoustic tube 250 to the inner cross-sectional area S ($mm^2$) of 102 (1/mm) is configured, it is possible to generate the anti-resonance having the resonance frequency fh of around 350 (Hz) to obtain the stepwise sound pressure level characteristic.

As described above, in the present embodiment, it is possible to design the structure of the acoustic tube 250 and the driver unit 210 in the headphone 20 by using Formulas (1) to (3) described above. Here, the design of the acoustic tube 250 and the driver unit 210 will be described more specifically by using numerical values.

A value of the volume V ($mm^3$) of the driver-unit rear-face air chamber 218 is almost determined by the diameter of the frame 211 of the driver unit 210. Here, the size of the driver unit 210, that is, the diameter of the frame 211 can be limited to some specific values by standards. For example, in a relatively small headphone such as a canal-type earphone, the driver unit 210 having a relatively small size is preferably applied. Here, as an example of the driver unit 210 assumed to be preferably applied in the canal-type earphone, a case of the frame 211 of the driver unit 210 having the diameter of 9 (mm) or 16 (mm) will be considered.

For the driver unit 210 having these standards, the relationship between the resonance frequency fh of the anti-resonance, and the length L and the inner cross-sectional area S of the acoustic tube 250 was calculated specifically by using Formulas (1) to (3) described above. The calculation results are shown in the table described below. When the diameter of the frame 211 is 9 (mm), the volume V ($mm^3$) of the driver-unit rear-face air chamber 218 can be considered to be around 50 ($mm^3$). Further, when the diameter of the frame 211 is 16 (mm), the volume V ($mm^3$) of the driver-unit rear-face air chamber 218 can be considered to be around 180 ($mm^3$). Accordingly, in the calculation for obtaining the table below, as a value of the volume V ($mm^3$) of the driver-unit rear-face air chamber 218, 50 ($mm^3$) and 180 ($mm^3$) were used.

TABLE 1

| | L/S(1/$mm^2$) | |
|---|---|---|
| Resonance frequency fh(Hz) | Diameter (mm) (V = 50($mm^3$)) | Diameter 16(mm) (V = 180($mm^3$)) |
| 150 | 1999 | 540 |
| 180 | 1389 | 374 |
| 200 | 1124 | 303 |
| 300 | 500 | 135 |
| 350 | 377 | 101 |
| 400 | 281 | 76 |
| 500 | 179 | 48 |
| 600 | 125 | 35 |

With reference to the table above, it turns out that the ratio L/S (1/mm) of the length L (mm) to the inner cross-sectional area S ($mm^2$) in the acoustic tube 250 should be 76 to 1124 (1/mm) in order to be set so that the resonance frequency fh is included in 200 (Hz) to 400 (Hz). Further, when the volume V ($mm^3$) of the driver-unit rear-face air chamber 218 is 50 ($mm^3$), it turns out that the ratio L/S (1/mm) should be 281 to 1124 (1/mm) in order to be set so that the resonance frequency fh is included in 200 (Hz) to 400 (Hz). Further, when the volume V ($mm^3$) of the driver-unit rear-face air chamber 218 is 180 ($mm^3$), it turns out that the ratio L/S (1/mm) should be 76 to 303 (1/mm) in order to be set so that the resonance frequency fh is included in 200 (Hz) to 400 (Hz).

As described above, in the present embodiment, the shape (the length and the inner cross-sectional area) of the acoustic tube 250 and the shape of the driver unit 210 can be designed so that the resonance frequency fh is included in the desired frequency band, for example, 200 (Hz) to 400 (Hz), by using Formulas (1) to (3) described above. In the example described above, as an example of the method for designing the acoustic tube 250 and the driver unit 210 according to the present embodiment, the method for designing the acoustic tube 250 and the driver unit 210 has been described on the condition that the resonance frequency fh is included in 200 (Hz) to 400 (Hz), and the volume V ($mm^3$) of the driver-unit rear-face air chamber 218 is 50 ($mm^3$) or 180 ($mm^3$), but the present embodiment is not limited thereto. Also on the condition that the resonance frequency fh is included in another frequency band, or on the condition that the volume V ($mm^3$) of the driver-unit rear-face air chamber 218 has another value, it is possible to design the acoustic tube 250 and the driver unit 210 by using the same method described above.

Note that, when a value of the length L (mm) and the inner cross-sectional area S ($mm^2$) of the acoustic tube 250 is designed, machining accuracy in manufacturing the acoustic tube 250 may be considered. For example, a minimum value of the length L (mm) and the inner cross-sectional area S ($mm^2$) may be limited to such a value that the acoustic tube 250 can be manufactured within a predetermined dimensional tolerance. Further, when designing the driver unit 210, a shape of the housing 240 accommodating the driver unit 210 and an acoustic characteristic of sound generated by the driver unit 210 can be considered. When the canal-type earphone exemplified in FIG. 4 is used, a size of the housing 240 is relatively small, and for example when a so-called overhead-type headphone is used, a size of the housing 240 is larger. Further, a shape of the housing can be set also in consideration of wearability and designability of the headphone 20 by a user. Further, a shape of the driver unit 210 can directly affect an acoustic characteristic of sound generated by the driver unit 210. Therefore, in design of a shape of the driver unit 210, a shape of the housing 240, an acoustic characteristic of the driver unit 210 and the like may be comprehensively considered.

Here, for example, as described in Patent Literature 1 and Patent Literature 2, an acoustic characteristic of the existing headphone will be considered. For example, in the headphone described in Patent Literature 1, a configuration corresponding to the acoustic tube 250 is not provided. Therefore, the acoustic equivalent circuit of the headphone described in Patent Literature 1 corresponds to one where the inductance Mb and the resistor Rb2 do not exist in the acoustic equivalent circuit 40 of FIG. 2. Therefore, the anti-resonance by the capacitor Cb and the inductance Mb cannot bet generated, so that the dip of the sound pressure level is not formed. In this manner, since a configuration corresponding to the acoustic tube 250 is not provided in the existing headphone, only a value of the resistor Rb1 exists as a parameter for adjusting the sound pressure level, making it difficult to obtain the stepwise sound pressure level characteristic. On the other hand, in the present embodiment, the dip of the sound pressure level due to the anti-resonance can be formed in the predetermined frequency by providing the acoustic tube 250. Since the dip can form a stepwise shape in the stepwise sound pressure level characteristic, for example, the stepwise sound pressure level characteristic described above can be realized. In this manner, in the present embodiment, since a parameter for adjusting the sound pressure level characteristic is increased, it becomes possible to easily realize the desired sound pressure level characteristic to further improve the acoustic characteristics.

Furthermore, for example, in the headphone described in Patent Literature 2 described above, the duct structure similar to the acoustic tube 250 according to the present embodiment is provided. Therefore, in the existing headphone, the anti-resonance due to the capacitor Cb in the driver-unit rear-face air chamber and the inductance Mb in the duct structure can be generated. The investors created the acoustic equivalent circuit for the headphone described in Patent Literature 2 described above, and similarly to the above description, calculated a relationship between the resonance frequency fh of the anti-resonance, and the length L and the inner cross-sectional area S in the duct structure and the volume V of the driver-unit rear-face air chamber. As a result, in the headphone described in Patent Literature 2 described above, it turns out that the L/S (1/mm) of the tubular duct structure is around 11 (1/mm), and the resonance frequency fh is around 500 (Hz). In order to obtain the sound pressure level characteristic where the sound pressure level is reduced in a stepwise manner from the low range to the middle range, as described above, it is preferable that the resonance frequency fh is included in 200 (Hz) and 400 (Hz), but it can be said that the resonance frequency fh in the existing headphone described in Patent Literature 2 described above is not included in this range.

Figure 11:
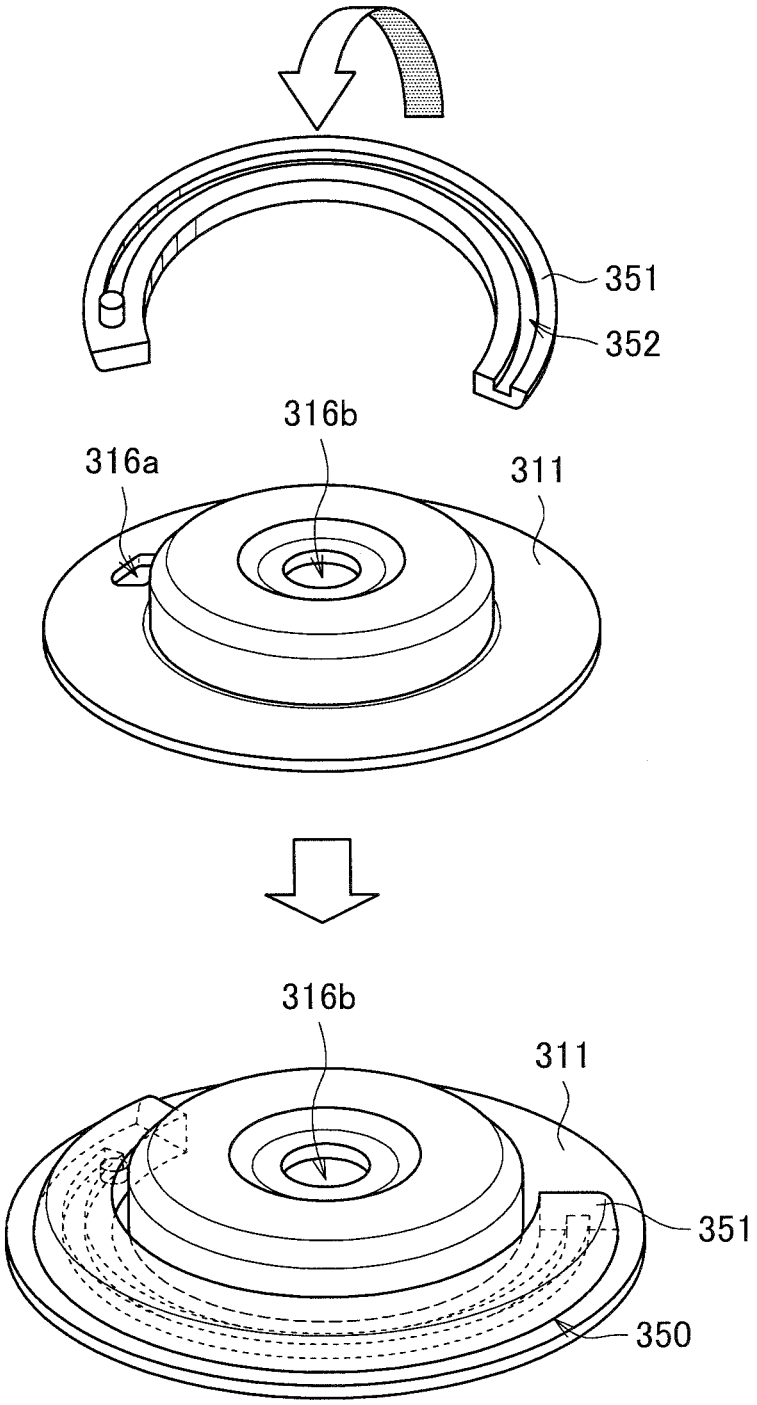
FIG. 11 is an explanatory diagram for explaining a structure of an acoustic tube according to the present modification.

Here, in the headphone described in Patent Literature 2 described above, the tubular duct structure is formed in one part of the housing. Therefore, in order to change the length L and the inner cross-sectional area S of the tube, it is necessary to change a shape of the housing, so that the resonance frequency fh cannot be easily adjusted. In this manner, in the headphone described in Patent Literature 2 described above, it is difficult to adjust the value, for example, so that the resonance frequency fh is included in 200 (Hz) to 400 (Hz). On the other hand, in the present embodiment, the acoustic tube 250 is configured by the relatively simple configuration, for example, as shown in FIG. 5 and FIG. 11 to be described later. Further, the acoustic tube 250, for example, as shown in FIG. 5, can adjust the resonance frequency fh more easily by changing the length and the inner cross-sectional area of the tube 252. In this manner, in the present embodiment, it is possible to adjust the sound pressure level characteristic by the more simple method, so that, for example, the stepwise sound pressure level characteristic as described above can be realized more easily.

Furthermore, in the headphone described in Patent Literature 2 described above, similarly to the present embodiment, the housing is formed by joining the front housing covering the front face side of the driver unit, and the rear housing covering the rear face side of the driver unit together. The tubular duct structure is formed in the partial region of the rear housing, and spatially connects the rear-face air chamber with the outside of the housing. Therefore, for example, when the volume of the rear-face air chamber changes for the reasons that a gap is generated in the junction part between the front housing and the rear housing, or the like, since the relationship between the capacitance component of the rear-face air chamber, and the resistance component and the inductance component of the tubular duct structure changes, the tubular duct structure may not exhibit the desired performance. In this manner, in the headphone described in Patent Literature 2 described above, in order to realize the desired acoustic characteristic, the high airtightness of the rear-face air chamber is required. On the other hand, in the present embodiment, on end of the acoustic tube 250 is directly connected to the frame 211 of the driver unit 210, and the acoustic tube 250 spatially connects the driver-unit rear-face air chamber 218 with the rear-face air chamber 232 as the outside of the driver unit 210. Further, the rear-face air chamber 232 is spatially connected to the outside of the housing 240 via the opening 231 while there is almost no resistance. Therefore, in the present embodiment, for example, even when a gap is generated in the junction part between the front housing 220 and the rear housing 230 to reduce the airtightness of the rear-face air chamber 232, the performance of the acoustic tube 250 does not change and the desired sound pressure level characteristic can be realized. Further, since the frame 211 of the driver unit 210 can be integrally molded as a plate-like member, the driver-unit rear-face air chamber 218 hardly causes a reduction in airtightness due to assembly of the members. In this manner, in the present embodiment, it becomes possible to improve the acoustic characteristic more stably.

<4. Modification>

Next, with reference to FIG. 8A to FIG. 12B, a modification of the headphone according to an embodiment of the present disclosure will be described. The headphone according to the present modification is a so-called multi-way headphone on which a plurality of driver units are mounted.

Here, the headphone according to the present modification is a canal-type earphone where an acoustic tube projected in a partial region of a housing is inserted into the external auditory canal of a user. Further, the headphone according to the present modification is inserted into the external auditory canal so that the rear face side faces a rear side of the user, and the front face side faces a front side of the user. In the description of the present modification below, the horizontal direction and the vertical direction when viewed from the user while the headphone according to the present modification is inserted into the external auditory canal of the user, are referred to as an x-axis direction and a y-axis direction, respectively.

Figure 8A:
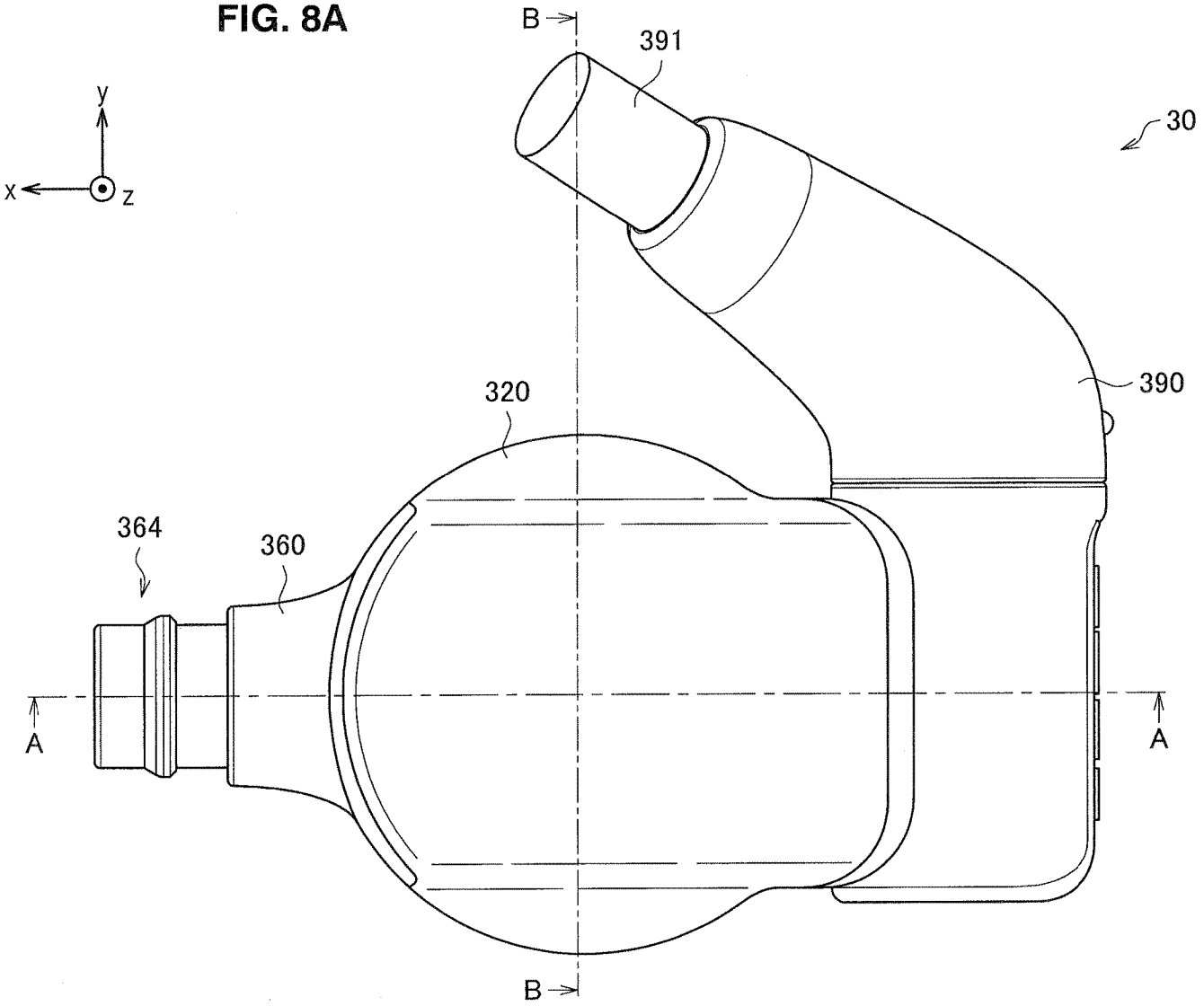
FIG. 8A is an appearance diagram illustrating a configuration of a headphone according to a modification of an embodiment of the present disclosure.

With reference to FIG. 8A to FIG. 10B, a configuration of the headphone according to a modification of an embodiment of the present disclosure will be described. FIG. 8A to FIG. 8D are an appearance diagram illustrating a configuration of the headphone according to a modification of an embodiment of the present disclosure. FIG. 8A is an appearance diagram illustrating a state of the headphone according to the present modification when it is viewed from the front face side (that is, a positive direction of the z axis). FIG. 8B is an appearance diagram illustrating a state of the headphone according to the present modification when it is viewed from the rear face side (that is, a negative direction of the z axis). FIG. 8C is an appearance diagram illustrating a state of the headphone according to the present modification when it is viewed from the y-axis direction. FIG. 8D is an appearance diagram illustrating a state of the headphone according to the present modification when it is viewed from the x-axis direction.

Figure 8B:
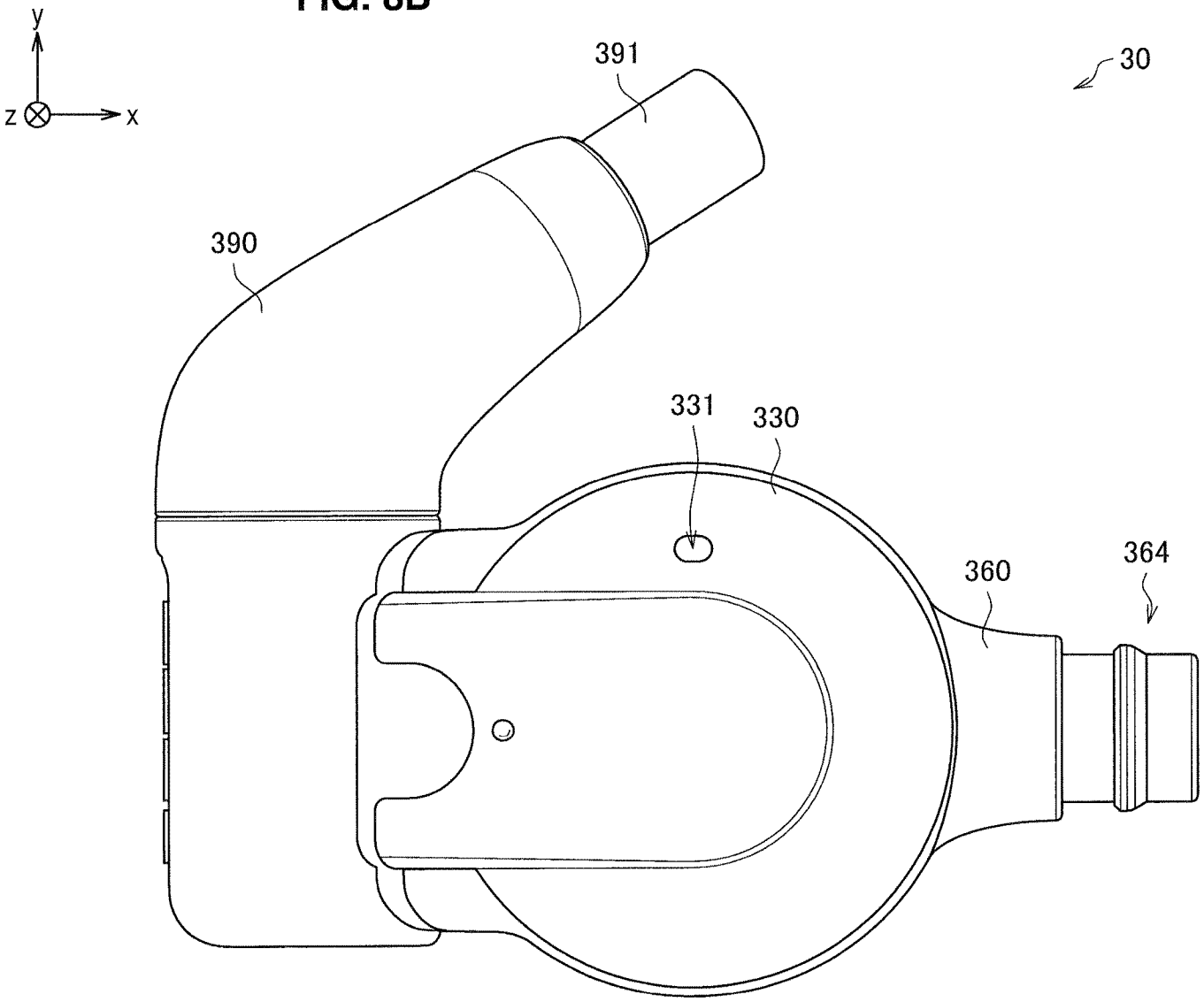
FIG. 8B is an appearance diagram illustrating a configuration of a headphone according to a modification of an embodiment of the present disclosure.
Figure 8C:
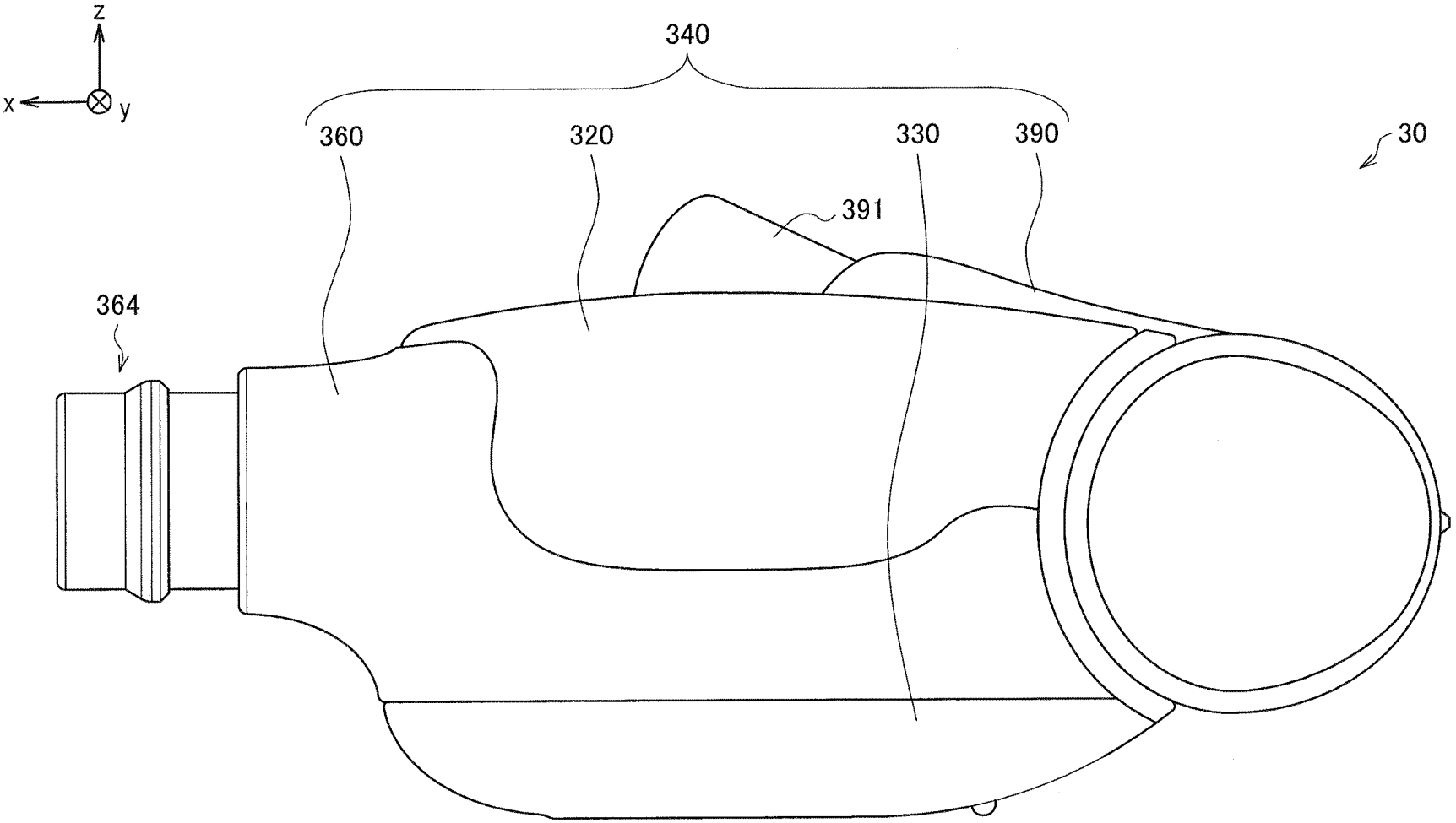
FIG. 8C is an appearance diagram illustrating a configuration of a headphone according to a modification of an embodiment of the present disclosure.
Figure 8D:
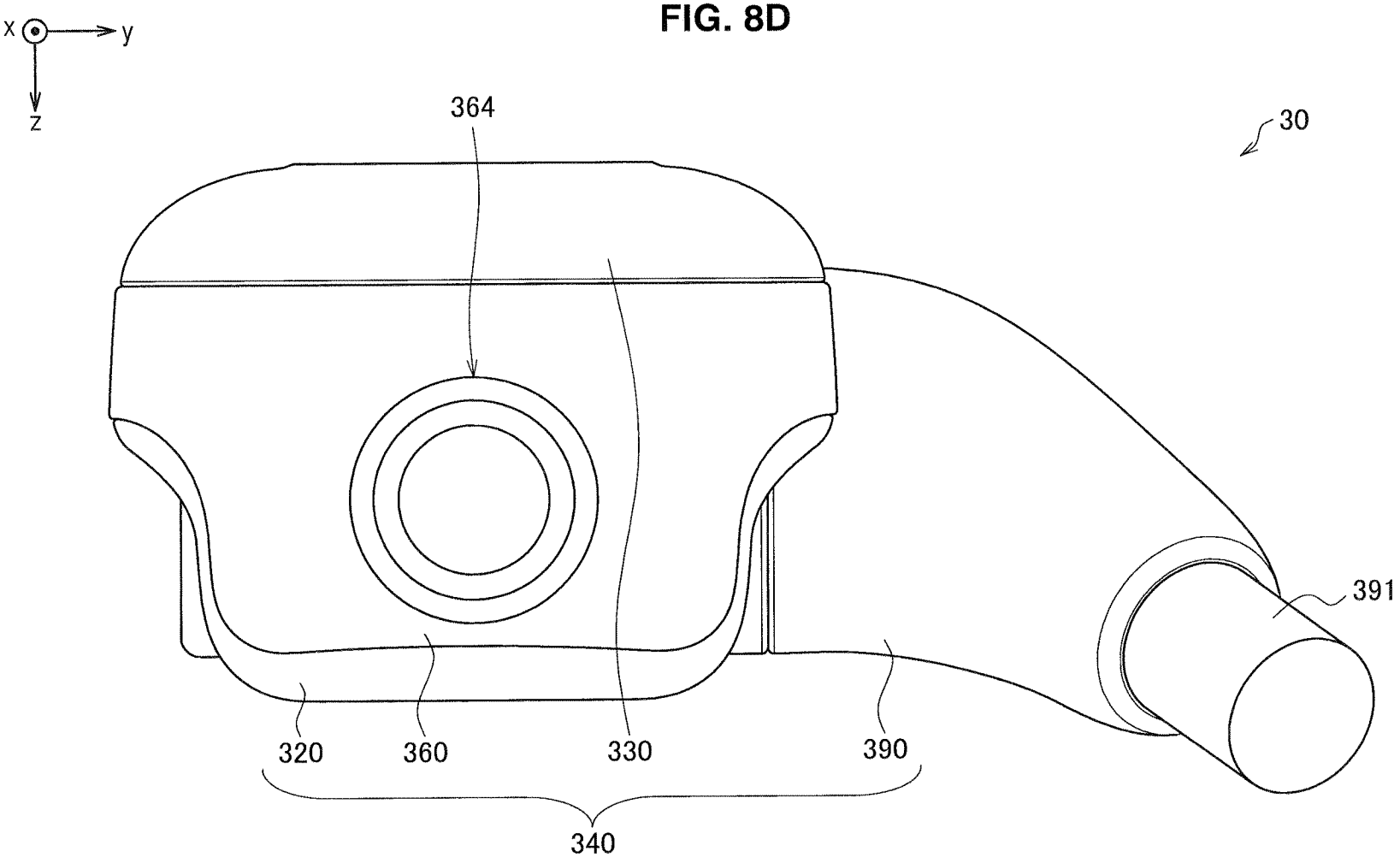
FIG. 8D is an appearance diagram illustrating a configuration of a headphone according to a modification of an embodiment of the present disclosure.
Figure 9A:
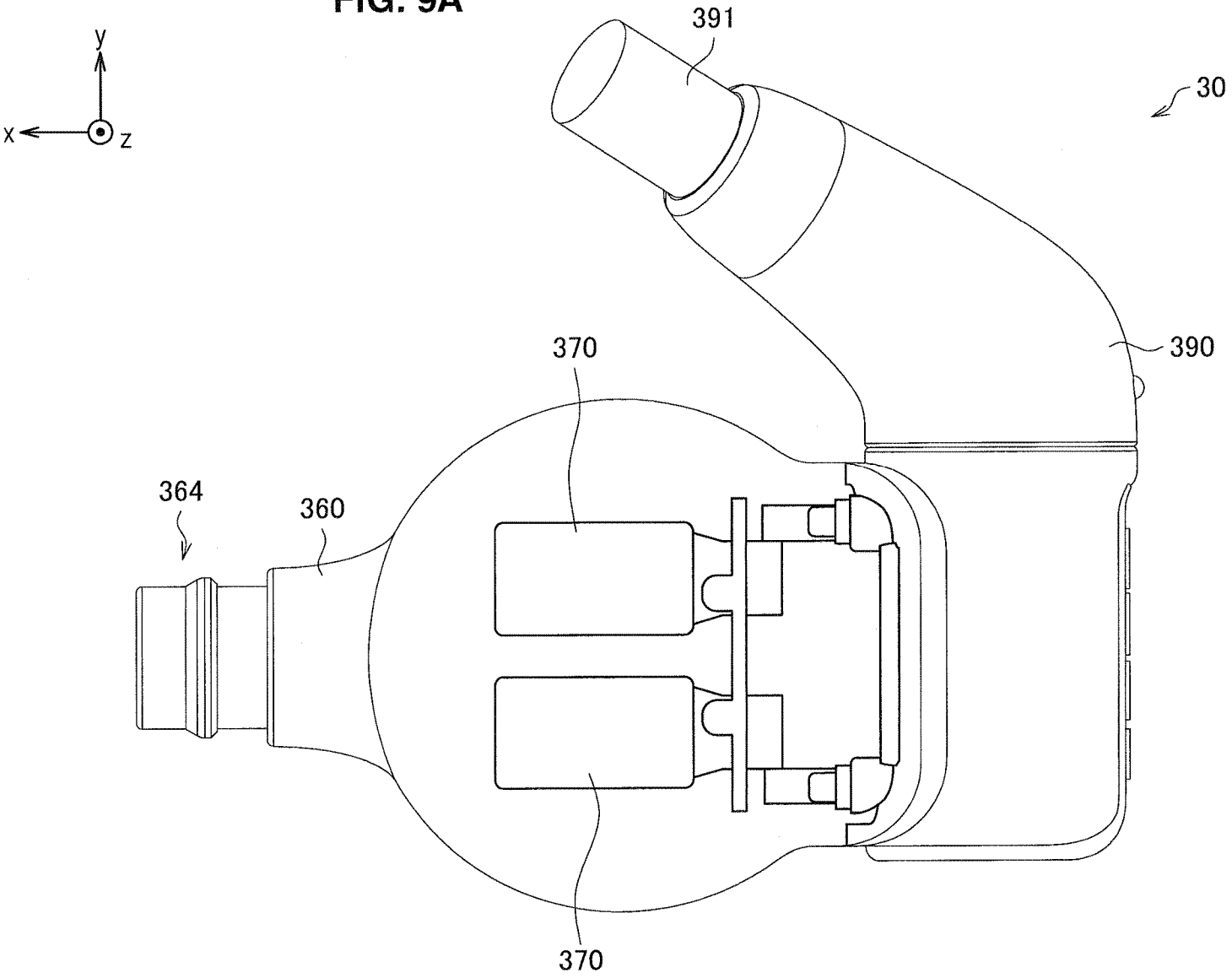
FIG. 9A is a diagram virtually transparently illustrating a part of a housing and illustrating a state of structural members within the housing, in the headphone of FIG. 8A.
Figure 9B:
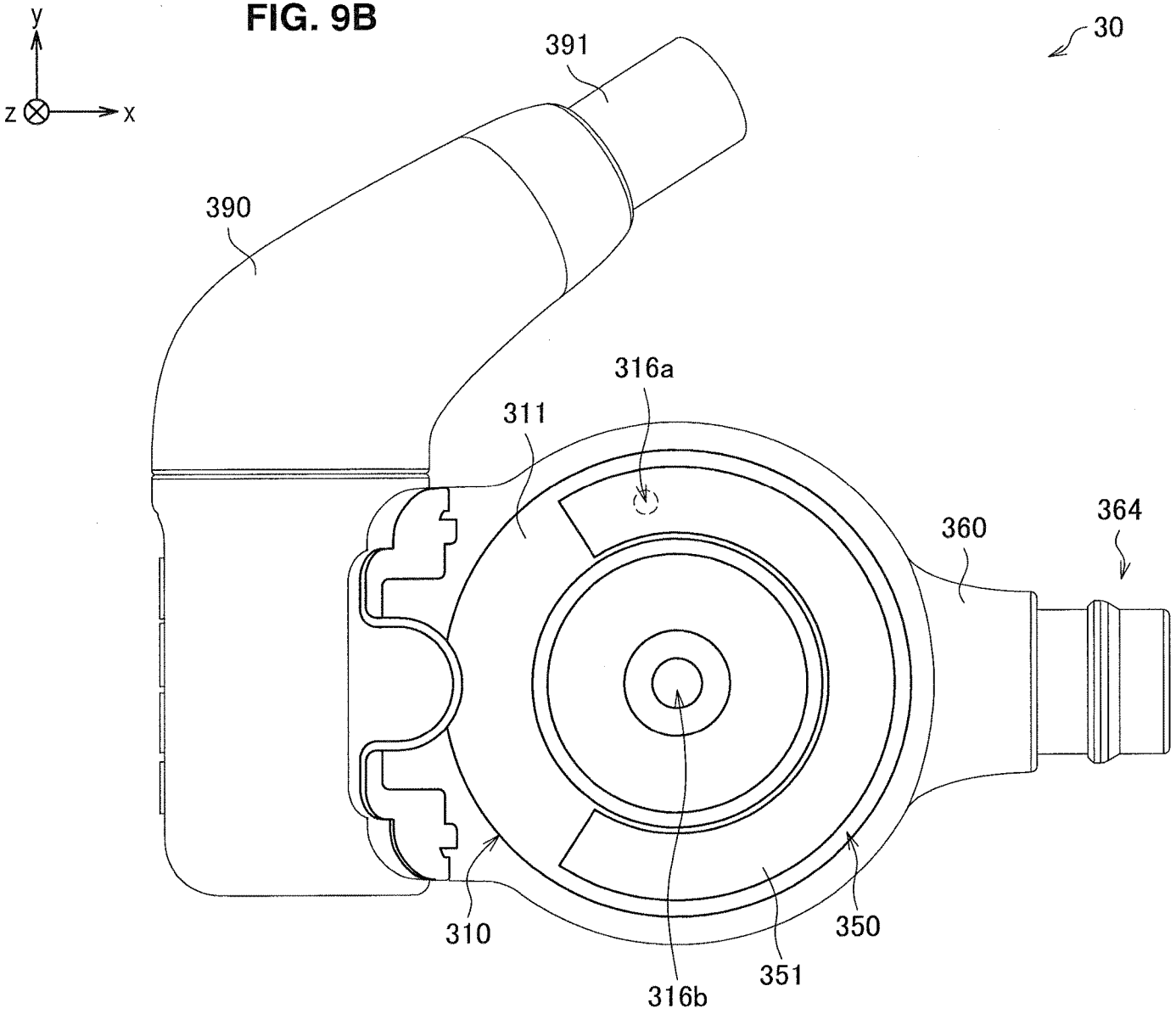
FIG. 9B is a diagram virtually transparently illustrating a part of a housing and illustrating a state of structural members within the housing, in the headphone of FIG. 8B.
Figure 9C:
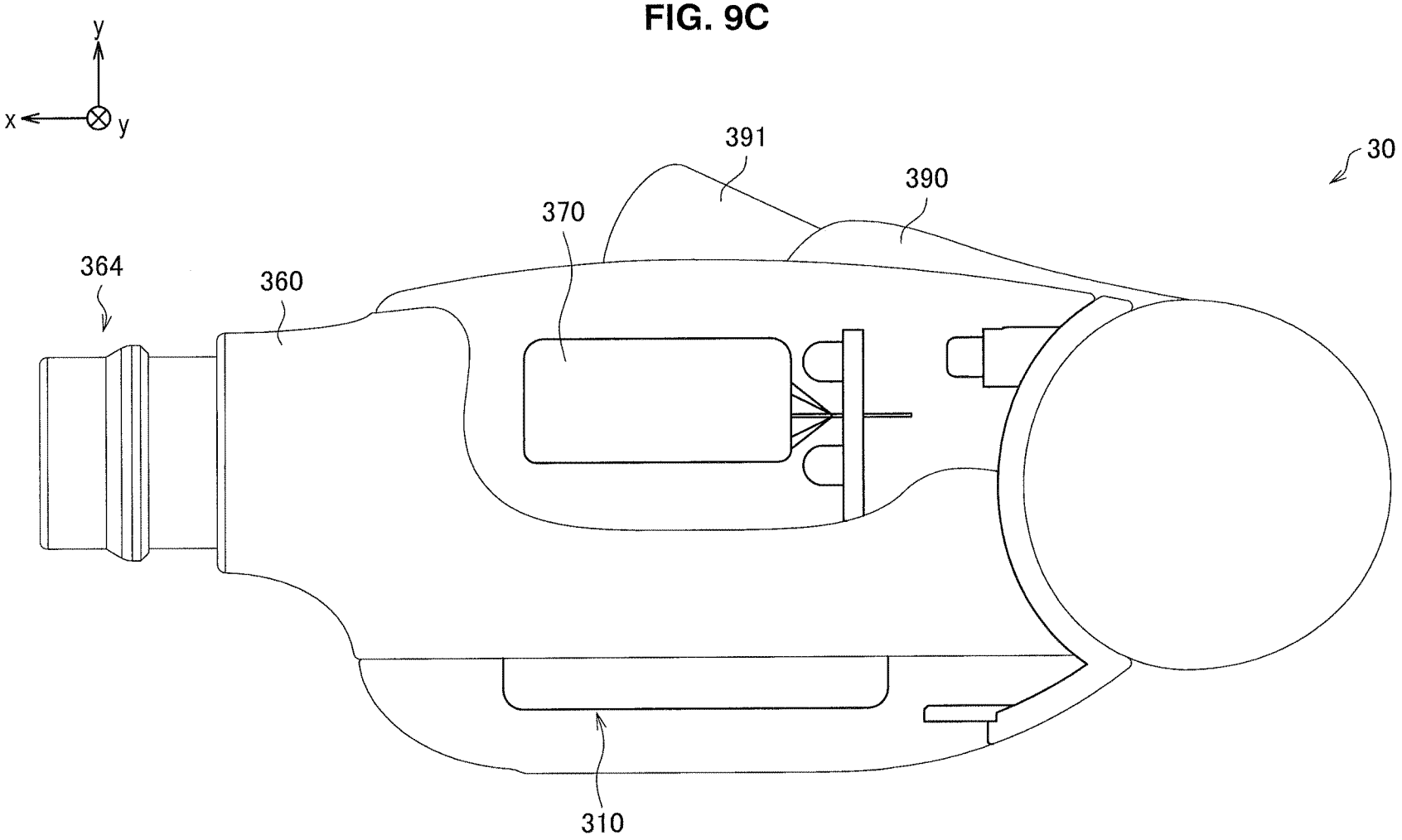
FIG. 9C is a diagram virtually transparently illustrating a part of a housing and illustrating a state of structural members within the housing, in the headphone of FIG. 8C.

Furthermore, FIG. 9A to FIG. 9C are a diagram virtually transparently illustrating a part of the housing and illustrating a state of structural members within the housing, in the headphone of FIG. 8A to FIG. 8C. FIG. 9A transparently illustrates a part of the housing facing the positive direction of the z-axis (a front housing 320 to be described later) in the headphone of FIG. 8A. FIG. 9B transparently illustrates a part of the housing facing the negative direction of the z-axis (a rear housing 330 to be described later) in the headphone of FIG. 8B. FIG. 9C transparently illustrates a part of the housing facing the positive direction and the positive direction of the z-axis (the front housing 320 and the rear housing 330) in the headphone of FIG. 8C. Note that, in FIG. 9A to FIG. 9C, the structural members within the housing that can be observed passing through the front housing 320 and/or the rear housing 330 are indicated by the thick line, and the other members are indicated by the thin line.

Figure 10A:
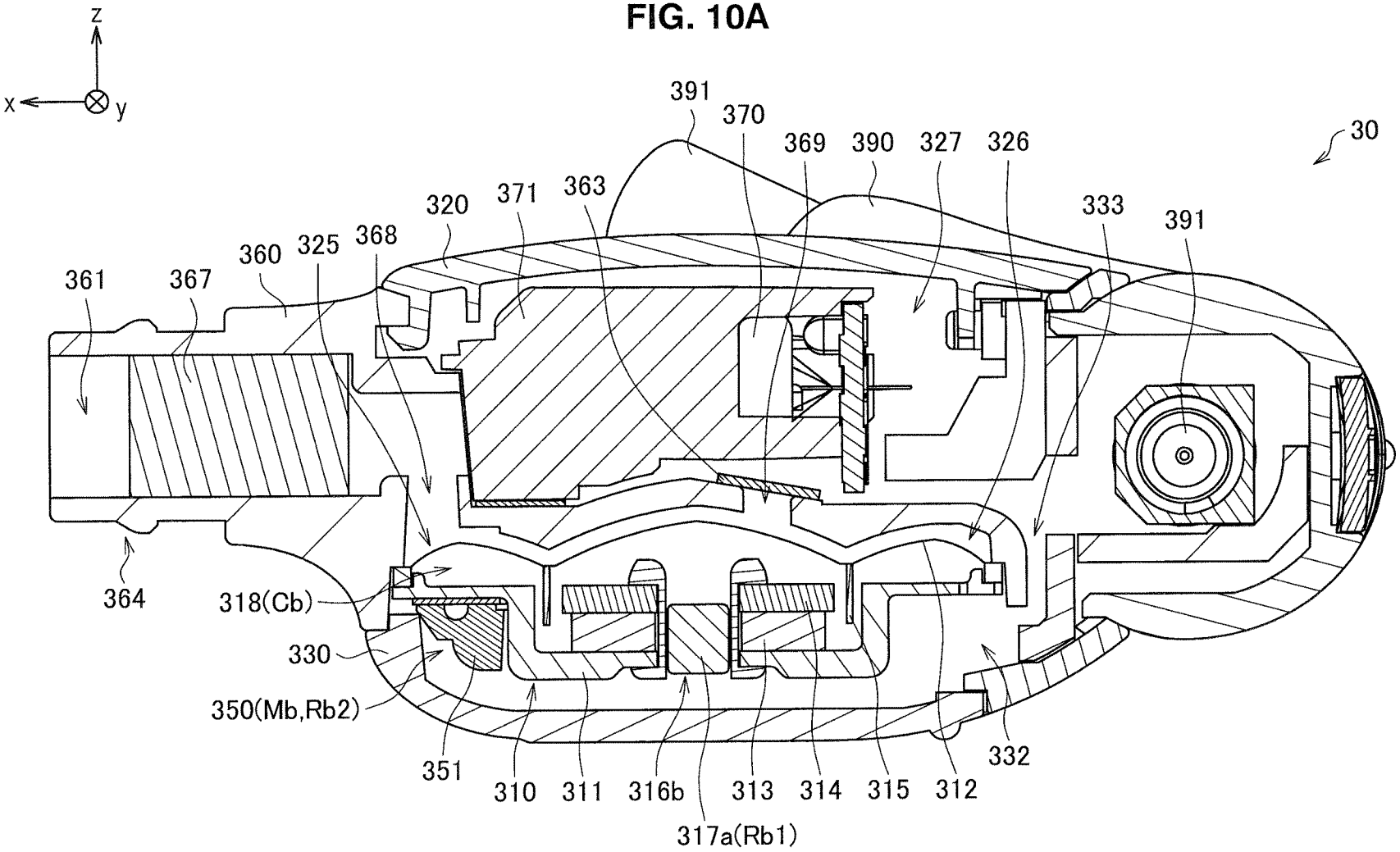
FIG. 10A is a cross-sectional diagram of the headphone of FIG. 8A.
Figure 10B:
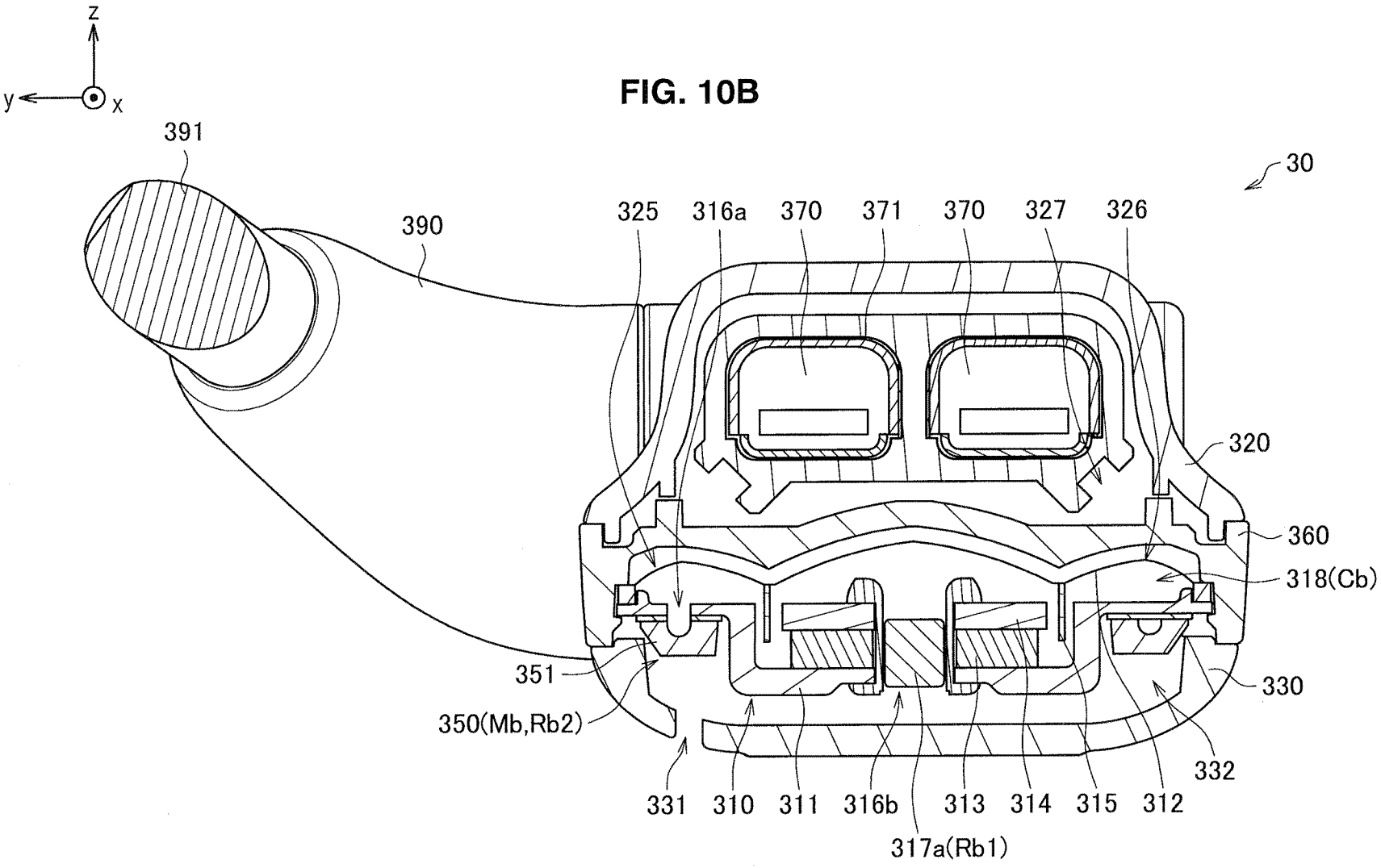
FIG. 10B is a cross-sectional diagram of the headphone of FIG. 8A.

Furthermore, FIG. 10A and FIG. 10B are a cross-sectional diagram of the headphone of FIG. 8A. FIG. 10A is a cross-sectional diagram illustrating a state in the A-A cross section of the headphone of FIG. 8A. FIG. 10B is a cross-sectional diagram illustrating a state in the B-B cross section of the headphone of FIG. 8A.

With reference to FIG. 8A to FIG. 10B, the headphone 30 according to the present embodiment includes a dynamic-type driver unit 310, a BA-type driver unit 370, and a housing 340 accommodating the dynamic-type driver unit 310 and the BA-type driver unit 370 therein. Note that the structural members illustrated in FIG. 8A to FIG. 10B are simplified for the description of the present embodiment, and the headphone 30 may further include structural members not shown. Since a function configuration not shown can be already known as a configuration in the existing typical headphone, the detailed description is omitted.

Here, the headphone 30 according to the present modification corresponds to one where the BA-type driver unit 370 is further mounted on the headphone 20 of FIG. 4. Therefore, also in the headphone 30 according to the present modification, a part of the structural members corresponds to the configuration of the headphone 10 described with reference to FIG. 1. In the description of each structural member of the headphone 30, a correspondence relationship with each structural member of the headphone 10 of FIG. 1 will be described. Further, since the corresponding structural members have functions similar to each other, the detailed descriptions for ones corresponding to the structural members already described with reference to FIG. 1 in the structural members of the headphone 30 are omitted. Further, the acoustic equivalent circuit of the headphone 30 can be one where elements corresponding to the structural members newly added in the present modification are added to the acoustic equivalent circuit 40 of FIG. 2. Therefore, similarly to FIG. 1, symbols of the elements in the acoustic equivalent circuit 40 are added to signs with which the structural members of the headphone 30 are partially denoted.

The dynamic-type driver unit 310 has a frame 311, a diaphragm 312, a magnet 313, a plate 314, and a voice coil 315. The dynamic-type driver unit 310 corresponds to the driver unit 110 of FIG. 1. Further, the frame 311, the diaphragm 312, the magnet 313, the plate 314, and the voice coil 315 correspond to the frame 111, the diaphragm 112, the magnet 113, the plate 114, and the voice coil 115 of FIG. 1. A driver-unit rear-face air chamber 318 is formed between the frame 311 and the diaphragm 312. An element corresponding to electromotive force when the diaphragm 312 is vibrated corresponds to the signal source (electromotive force) Vs in the acoustic equivalent circuit 40. Further, mass, mechanical resistance and compliance in the dynamic-type driver unit 310 corresponds to the inductance Mo, the resistance Ro and the capacitor Co in the acoustic equivalent circuit 40, respectively. Further, the volume of the driver-unit rear-face air chamber 318 corresponds to the capacitor Cb in the acoustic equivalent circuit 40.

In the frame 311 of the dynamic-type driver unit 310, provided are ventilation holes 316*a* and 316*b* penetrating the frame 311 in the z-axis direction. The ventilation holes 316*a* and 316*b* correspond to the ventilation holes 116*a* and 116*b* shown in FIG. 1. The ventilation hole 316*a* is formed at a position radially shifted from the center of the frame 311 by a predetermined distance, and spatially connects the edge part of the driver-unit rear-face air chamber 318 with the outside of the dynamic-type driver unit 310. Further, the ventilation hole 316*b* is formed at the substantial center of the frame 311, and spatially connects the dome part of the driver-unit rear-face air chamber 318 with the outside of the dynamic-type driver unit 310.

In the ventilation hole 316*b*, a ventilation resistance body 317*a* is provided so as to block the hole. The ventilation resistance body 317*a* corresponds to the ventilation resistance body 117*b* of FIG. 1. A resistance component to a flow of air, of the ventilation resistance body 317*a* corresponds to the resistor Rb1 in the acoustic equivalent circuit 40.

Here, a material and a shape of the ventilation resistance body 317*a* may be optionally set so as to obtain the desired sound pressure level characteristic, for example, in consideration of the sound pressure level characteristic as shown in FIG. 3. More specifically, as described with reference to FIG. 3, a material and a shape of the ventilation resistance body 317*a* can be optionally set so that a value of the resistor Rb1 for obtaining the stepwise sound pressure level characteristic can be realized.

To the ventilation hole 316*a*, one end of the acoustic tube 350 is connected. Here, with reference to FIG. 11, a configuration of the acoustic tube 350 in the headphone 30 will be described in more detail. FIG. 11 is an explanatory diagram for explaining a structure of the acoustic tube 350 according to the present modification. In FIG. 11, for convenience, only the frame 311 of the structural members of the dynamic-type driver unit 310 is shown, and a state where a rod-like member to be described later is removed from the frame 311, and a state where the acoustic tube 350 is formed by attaching the rod-like member 351 to the frame 311 are shown.

With reference to FIG. 11, the acoustic tube 350 is configured by the rod-like member 351. A groove 352 is formed in one face of the rod-like member 351 in a longitudinal direction. Further, at least one end of the groove 352 is formed so as to reach an end of the rod-like member 351. The acoustic tube 350 is formed by arranging the rod-like member 351 so that a face on which the groove 352 of the rod-like member 351 is formed is closely fitted to one face on a rear face side of the frame 311, and at least one part of the groove 352 is in contact with the ventilation hole 361*a*. When the rod-like member 351 is arranged in this manner, the acoustic tube 350 having a tubular structure is realized by one face of the frame 311 and the groove 352. Air flown into the groove 352 via the ventilation hole 316*a* from the driver-unit rear-face air chamber 318 is flown out to the outside of the dynamic-type driver unit 310 through the tubular structure configured by one face of the frame 311 and the groove 352.

Here, the acoustic tube 350 is a member corresponding to the acoustic tube 150 of FIG. 1. The acoustic tube 350 spatially connects the driver-unit rear-face air chamber 318 with the outside of the dynamic-type driver unit 310 via the tube. As shown in FIG. 11, in the present modification, the tubular part of the acoustic tube 359 is configured by the groove 352 of the rod-like member 351. Therefore, it can be said that an inductance component and a resistance component to a flow of air in the acoustic tube 350 correspond to an inductance component and a resistance component to a flow of air in the groove 352 of the rod-like member 351. The inductance component and the resistance component correspond to the inductance Mb and the resistor Rb in the acoustic equivalent circuit 40, respectively.

Note that a part of the rod-like member 351 in contact with the ventilation hole 361*a* may be a part corresponding to one end of the groove 352, and a projection engaged with the ventilation hole 361*a* may be provided in one end of the groove 351. Providing the projection makes it easy to mount the rod-like member 351 to the frame 311 and allows the rod-like member 351 to be securely mounted to the frame 311. However, a size of the projection is set to such a size that the ventilation hole 316*a* is not totally blocked, preventing a flow of air from the driver-unit rear-face air chamber 318 to the groove 352 from being disturbed. Further, contact faces between the rod-like member 351 and the frame 311 may be bonded, for example, by various types of adhesives, a double-sided tape, or the like. When the contact faces between the rod-like member 351 and the frame 311 are bonded, for example, by an adhesives, or the like, the ventilation hole 316*a* is spatially connected to the groove 352 while leakage of air to the outside from a part other than the groove 352 is almost eliminated, so that air within the driver-unit rear-face air chamber 318 is securely flown into the groove 352 (that is, into the acoustic tube 350).

Furthermore, the rod-like member 351 may be curved so as to have the curvature substantially equal to or equal to or less than the circumference of the substantial disk-like frame 311. When the rod-like member 351 is curved so as to have the curvature substantially equal to or equal to or less than the circumference of the substantial disk-like frame 311, the rod-like member 351 will be arranged along the circumference direction of the frame 311 to allow the rod-like member 351 to be arranged in a smaller space, allowing the acoustic tube 350 to be provided without deforming a shape of the housing 340 or enlarging the housing 340.

Here, a length and an inner cross-sectional area of the groove 352 formed in the rod-like member 351 correspond to a length and an inner cross-sectional area of the acoustic tube 350. The length and the inner cross-sectional area of the groove 352 may be optionally set so as to obtain the desired sound pressure level characteristic, for example, in consideration of the sound pressure level characteristic shown in FIG. 3. More specifically, as described with reference to FIG. 3, the length and the inner cross-sectional area of the groove 352 can be optionally set so as to realize a value of such a capacitor Cb and inductance Mb that the resonance frequency generating the anti-resonance is located in the desired frequency band. Specifically, the length and the inner diameter of the groove 352 may be optionally set by the method described in <3. Method for Designing Acoustic Tube and Driver Unit> described above.

In this manner, in the present embodiment, the acoustic tube 350 is formed by a relatively simple configuration of the rod-like member 351. Here, as described with reference to FIG. 1, the dynamic-type driver unit 310 according to the present embodiment may have a configuration similar to that of the existing typical dynamic-type driver unit except for being provided with the acoustic tube 350. Therefore, in the present embodiment, it is possible to manufacture the acoustic tube 350 according to the present embodiment only by forming the ventilation hole 361*a* in the frame of the existing typical dynamic-type driver unit and mounting the rod-like member 351 thereon. Therefore, the improvement in the sound characteristic is realized at lower costs. Note that, in the example shown in FIG. 11, only the one ventilation hole 316*a* is provided in the frame 311, but the present modification is not limited thereto. In the present modification, a plurality of ventilation holes 316*a* may be provided along the groove 352. When the plurality of ventilation holes 316*a* are provided, the ventilation holes 316*a* will be more securely in contact with the groove 351, and even when a positional shift between the ventilation holes 361*a* and the groove 352 or the like occurs, the ventilation holes 316*a* will be more securely in contact with the groove 351, preventing the ventilation from being insufficient.

Furthermore, the acoustic tube 350 according to the present modification is configured by the rod-like member 351, but the present modification is not limited thereto. In the present modification, the acoustic tube 350, similarly to the acoustic tube 250 of FIG. 5, may be configured by the attachment 251 and the tube 252. Further, conversely, the acoustic tube 350 configured by the rod-like member 351, similar to the acoustic tube 350 of FIG. 11, may be applied to the headphone 20 of FIG. 4. In this manner, in the present embodiment, the acoustic tube may be a tubular member having a predetermined length and inner cross-sectional area, and the specific configuration may be optionally set in consideration with costs of the procurement of members configuring the acoustic tube, the assembly of the members to the driver unit, and the like. Further, the acoustic tube according to the present embodiment may be formed integrally with the frame of the driver unit, for example.

Referring to FIG. 8A to FIG. 10B again, the description of the configuration of the headphone 30 will be continued. The housing 340 accommodates the dynamic-type driver unit 310 and the BA-type driver unit 370 therein. The housing 340 corresponds to the housing 140 of FIG. 1.

The housing may be configured by a plurality of members. In the example shown in FIG. 8A to FIG. 10B, unlike the headphone 10 of FIG. 1, the housing 340 is configured by four members. That is, the housing 340 includes the front housing 320 covering a front face side of the dynamic-type driver unit 310, the rear housing 330 covering a rear face side of the dynamic-type driver unit 310, a middle housing 360 located between the front housing 320 and the rear housing 330 and connecting between both, and a cable housing 390 covering a cable 391 supplying an audit signal to the dynamic-type driver unit 310 and the BA-type driver unit 370. In this manner, in the present modification, the front housing 320 is not directly connected to the rear housing 330, and the middle housing 360 is provided between both.

In a partition wall of the middle housing 360, provided is an opening 361 spatially connecting the inside of the housing 340 with the outside. The opening 361 corresponds to the opening 121 of FIG. 1, and is an opening for outputting sound to the outside. In a partial region of the middle housing 360, formed is a sound guiding tube 364 as a tubular part provided so as to project toward the outside, and the opening 361 is provided in a tip end part of the sound guiding tube 364. The sound guiding tube 361 corresponds to the sound guiding tube 124 of FIG. 1. In the outer circumference of the tip end part of the sound guiding tube 364, an earpiece (not shown except for FIG. 12B) is provided. When a user listen to sound, the tip end part of the sound guiding tube 364 including the earpiece is inserted into the external auditory canal of the user. Further, an equalizer 367 as a ventilation resistance body is provided inside the sound guiding tube 364. Since the equalizer 367 has a function similar to that of the equalizer 227 of FIG. 4, the detailed description is omitted.

In the present modification, a space within the housing 340 is divided into a dynamic-type driver-unit accommodation chamber 326 as a space accommodating the dynamic-type driver unit 310, and a BA-type driver-unit accommodation chamber 327 as a space accommodating the BA-type driver unit 370, by a partition wall 362 that can be formed integrally with the middle housing 360. As shown in FIG. 10A and FIG. 10B, the dynamic-type driver-unit accommodation chamber 326 is a space surrounded by the rear housing 330 and the partition wall 362, and the BA-type driver-unit accommodation chamber 326 is a space surrounded by the front housing 320 and the partition wall 362. Note that, in the present modification, the partition wall 362 may not be formed integrally with the middle housing 360, and may be arranged within the housing 340 as another member.

The dynamic-type driver-unit accommodation chamber 326 is further divided into a front-face air chamber 325 as a space on a side being provided with a diaphragm 312, and a rear-face air chamber 332 as a space on a side opposite to the side, by the frame 311 of the dynamic-type driver unit 310. As shown in FIG. 10A and FIG. 10B, the front-face chamber 325 is a space surrounded by the partition wall 362 and the frame 311, and the rear-face air chamber 332 is a space surrounded by the rear housing 330 and the frame 311. A volume of the front-face air chamber 325 corresponds to the capacitor C1 in the acoustic equivalent circuit 40.

In the BA-type driver-unit accommodation chamber 327, the two BA-type driver units 370 are accommodated. In the example shown in FIG. 9A, FIG. 10A and FIG. 10B, the two BA-type driver units 370 are arranged in the BA-type driver unit 327 while being accommodated within a driver-unit housing 371. The driver-unit housing 371 is a support member for fixing the BA-type driver unit 370 to a predetermined position, and has a function for defining a flow path around the BA-type driver unit 370 and controlling a flow of air. For example, a predetermined space around the BA-type driver unit 370 is sealed by the driver-unit housing 371, and a space on a front face side of the BA-type driver unit 370 is connected to a space provided with the sound guiding tube 364 by the flow path optionally provided within the driver-unit housing 371. In this manner, sound discharged from the BA-type driver unit 370 can be guided to a direction where the sound guiding tube 364 is provided, by the driver-unit housing 371.

In the partition wall 362, ventilation holes 333, 368 and 369 are provided. The ventilation hole 333 is provided at such a position as to spatially connect the rear-face air chamber 332 with the BA-type driver-unit accommodation chamber 327. Further, the ventilation hole 333 is formed so as to have such a size that it can be almost no resistance to a flow of air. In this manner, in the present modification, the BA-type driver-unit accommodation chamber 327 can be considered to be a part of the rear-face chamber 332.

In the partition wall 362, the ventilation hole 368 is formed at such a position as to spatially connect a space provided with the sound guiding tube 364 with the front-face air chamber 325. In this manner, the space provided with the sound guiding tube 364 can be said to be a part of the front-face air chamber 325. Sound discharged from the dynamic-type driver unit 310 reaches the sound guiding tube 364 via the ventilation hole 368 and is outputted to the outside. In this manner, in the headphone 30, the sound generated from the dynamic-type driver unit 310 is combined with the sound generated from the BA-type driver unit 370 in the space provided with the sound guiding tube 364, and is finally outputted to the outside from the opening 361. Further, a size of the ventilation hole 368 can be set in consideration with the acoustic characteristic of the sound generated from the dynamic-type driver unit 310. For example, it becomes possible to control the acoustic characteristic in the high range in the dynamic-type driver unit 310 by adjusting the size of the ventilation hole 368.

In the partition wall 362, the ventilation hole 369 is formed at such a position as to spatially connect the front-face air chamber 325 with the BA-type driver unit 370. Further, in the ventilation hole 369, a ventilation resistance body 363 is provided so as to block the ventilation hole 369. The ventilation resistance body 363 is formed of, for example, a material similar to that of a ventilation resistance body 317*a*, and acts as a resistance component to a flow of air. A resistance component to a flow of air between the front-face air chamber 325 and the BA-type driver-unit accommodation chamber 327 can be adjusted by a size of the ventilation hole 369, and a material and a shape of the ventilation resistance body 363. As described above, the BA-type driver-unit accommodation chamber 327 can be considered to be a part of the rear-face air chamber 332. Further, as described later, the rear-face air chamber 332 can be spatially connected to the outside of the housing 340 via the opening 331. Therefore, the adjustment of the resistance component to a flow of air between the front-face air chamber 325 and the BA-type driver-unit accommodation chamber 327 corresponds to the adjustment of a sealing degree of the front-face air chamber 325. The acoustic characteristic of the sound outputted from the opening 361 can be adjusted by adjusting the sealing degree. Therefore, the size of the ventilation hole 369, and the material and the shape of the ventilation resistance body 363 can be set in consideration of the acoustic characteristic of sound discharged from the dynamic-type driver unit 310 and the BA-type driver unit 370.

Here, the dynamic-type driver unit 310 and the BA-type driver unit 370 can be designed so as to output sound having different sound pressure level characteristics, respectively. For example, the dynamic-type driver unit 310 can be designed so that the sound pressure level in the low range and the high range is relatively large, and the BA-type driver unit 370 can be designed so that the sound pressure level in the middle range is relatively large. Further, the two BA-type driver units 370 may be designed so as to have the sound pressure level characteristics different from each other. The dynamic-type driver unit 310 and the BA-type driver units 370 are designed so as to mutually complement the sound pressure level when the sound outputted from the dynamic-type driver unit 310 is combined with the sound outputted from the two BA-type driver units 370, thereby realizing the excellent acoustic characteristic over the wide frequency band.

Note that, in the present modification, it is possible to apply a typical BA-type driver unit 370 as the BA-type driver unit 370. Therefore, the detailed description of a function and a configuration of the BA-type driver unit 370 is omitted. Further, the number of the BA-type driver units 370 mounted is not limited to the example shown in FIG. 8A to FIG. 10B. The number, the acoustic characteristic and the like of the BA-type driver unit 370 mounted may be optionally set in consideration of the acoustic characteristic of the dynamic-type driver unit 310 and the acoustic characteristic of the sound finally outputted.

Note that, in the example shown in FIG. 8A to FIG. 10B, when the resistance component of the ventilation resistance body 363 is sufficiently large, it can be considered that the opening spatially connecting the front-face air chamber 325 with the outside is not provided in the front-face air chamber 325 except for the opening 361. In this manner, the headphone 30 according to the present modification can be said to be a sealed-type headphone. The present modification is not limited thereto, however, in the front housing 320 and/or the middle housing 360, such another opening as to spatially connect the front-face air chamber 325 with the outside, corresponding to the opening 122 of FIG. 1, may be further provided in addition to the ventilation hole 369. When another opening is provided, however, a ventilation resistance body for almost blocking a flow of air can be arranged in the opening in order to allow the headphone 30 to be the sealed-type headphone.

In a partition wall of the rear housing 330, provided is an opening 331 spatially connecting the inside of the housing 340 with the outside. The opening 331 corresponds to the opening 131 of FIG. 1. That is, the opening 331 is formed so as to have such a size that it can be almost no resistance to a flow of air. In this manner, in the present modification, the rear-face air chamber 332 is connected to a space outside the housing 340 via the opening 331 while resistance to a flow of air does not almost exist. Therefore, similarly to the acoustic tubes 150 and 250, the other end of the acoustic tube 350 according to the present modification may be also provided within the rear-face air chamber 332, or may be provided outside the housing 340. In any case, it is possible to obtain the same acoustic characteristic.

The cable housing 390 accommodates the cable 391 for transmitting an audio signal therein. A shape of the cable housing 390 can be set according to a pull-out direction of the cable 391.

Figure 12A:
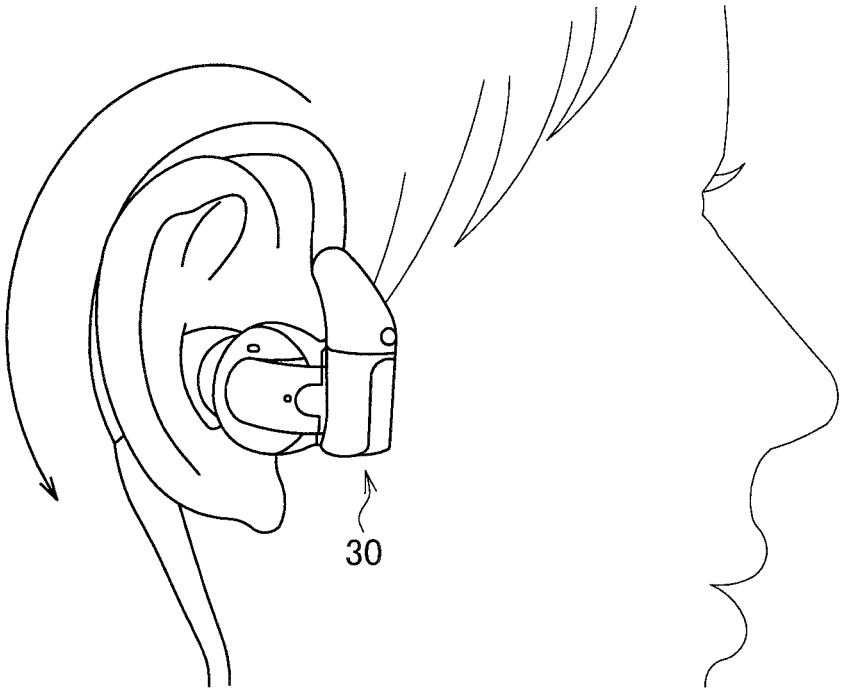
FIG. 12A is a schematic diagram illustrating a state of the headphone according to the present modification, being worn on a user.
Figure 12B:
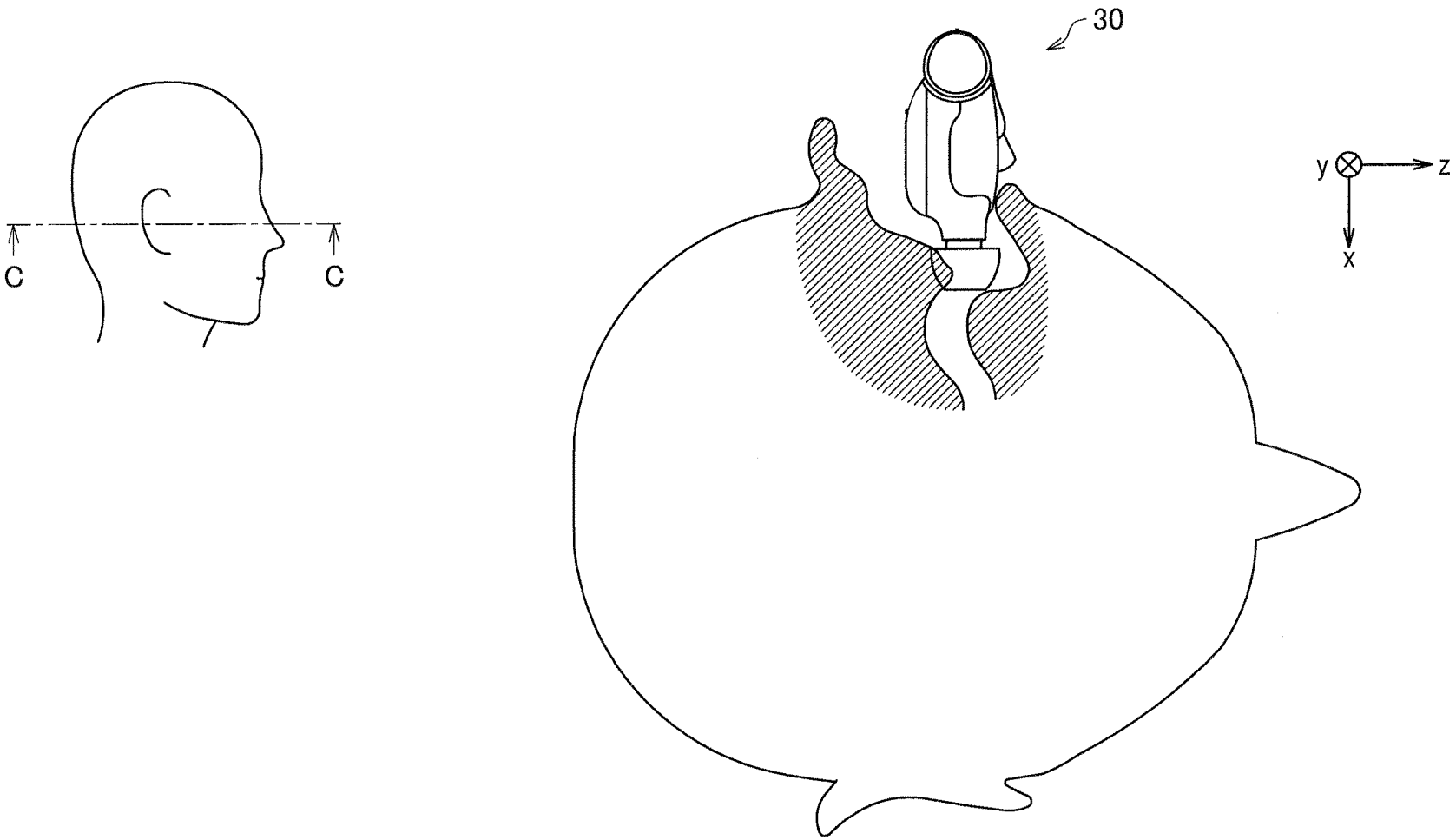
FIG. 12B is a schematic diagram illustrating a state of the headphone according to the present modification, being worn on a user.

Here, with reference to FIG. 12A and FIG. 12B, a wearing example of the headphone 30 according to the present modification will be described. FIG. 12A and FIG. 12B are a schematic diagram illustrating a state of the headphone 30 according to the present modification, being worn on a user. FIG. 12B illustrates a state in the C-C cross section of FIG. 12A.

With reference to FIG. 12A and FIG. 12B, when the sound guiding tube 364 of the headphone 30 is inserted into the external auditory canal of a user, the cable 391 is pulled out upward and diagonally forward when viewed from the user. The cable 391 is then suspended from the back of the auricle of the user so as to surround the auricle from the front to the back, and is connected with an acoustic apparatus outputting an audio signal. The cable 391 is pulled out to the direction shown in FIG. 12A and FIG. 12B, and is pulled out so as to surround the auricle of the user, to thereby improve the wearability when the user wears the headphone 30. However, the pull-out direction of the cable 391 is not limited thereto, and is optionally set in consideration of the wearability to the user.

Furthermore, as shown in FIG. 12A and FIG. 12B, the headphone 30 is inserted into the external auditory canal so that the rear face side faces the rear side of the user, and the front face side faces the front side of the user. As shown in FIG. 9A to FIG. 9C, FIG. 10A and FIG. 10B, in the headphone 30, the dynamic-type driver unit 310 is arranged on the rear face side, and the BA-type driver units 370 are arranged on the front face side. In this manner, the headphone 30 is worn so that the dynamic-type driver unit 310 is located on the back side of the user, and the BA-type driver units 370 are located on the front side of the user.

Here, for example, when the dynamic-type driver unit 310 is designed so that the sound pressure level in the low range is relatively large, and the BA-type driver units 370 are designed so that the sound pressure level in the higher range than that is relatively large, it is preferable that the BA-type driver units 370 are arranged at a position closer to the sound guiding tube 364 in order to secure the predetermined sound pressure level for the output of the BA-type driver units 370. Therefore, when the BA-type driver units 370 are arranged on the rear face side (that is, the back side of the user), it is necessary that the sound guiding tube 364 is also made projected from a region on a more back side of the housing 340. When the sound guiding tube 364 is provided on the back side, since such a configuration that it is provided on a relatively front side of the sound guiding tube 364 is often used, the housing 340 can have a shape swollen to the front side. When the housing 340 has a shape swollen to the front side, the housing may come into contact with the tragus when being worn, preventing the comfortable wearability. In the present modification, when the dynamic-type driver unit 310 is arranged on the rear face side, and the BA-type driver units 370 are arranged on the front face side, since the sound guiding tube 364 can be provided on a relatively front side, the predetermined sound pressure level for the output of the BA-type driver units 370 is secured and the comfortable wearability is realized.

With reference to FIG. 8A to FIG. 10B, the configuration of the headphone 30 according to a modification of an embodiment of the present disclosure has been described above in detail. Here, also in the headphone 30, similarly to the headphone 10 and the headphone 20 described above, it is possible to analyze the acoustic characteristic by using the sound equivalent circuit. However, in the headphone 30, the BA-type driver units 370 are added to the headphone 10 and the headphone 20. Further, the ventilation hole 369 for spatially connecting the front-face air chamber 325 with the rear-face air chamber 332 is provided. Therefore, in the analysis of the acoustic characteristic of the headphone 30, there can be used the acoustic equivalent circuit in consideration of elements generated by the facts that the BA-type driver units 370 are added to the acoustic equivalent circuit 40 of FIG. 2, and the ventilation hole 369 is provided in the acoustic equivalent circuit 40 of FIG. 2. Specifically, the analysis of the acoustic characteristic of the headphone 30 may be performed by using the acoustic equivalent circuit in which elements corresponding to vibratory force, mass, mechanical resistance and compliance in the BA-type driver units 370, a resistance element by the ventilation resistance body 323 provided in the ventilation hole 369, and the like are added to the acoustic equivalent circuit 40 of FIG. 2. Also in the acoustic equivalent circuit of the headphone 30, formed is the parallel resonance circuit generating the anti-resonance by the capacitor Cb of the driver-unit rear-face air chamber 318 and the inductance Mb of the acoustic tube 350. Therefore, in the acoustic equivalent circuit of the headphone 30, when a shape of the acoustic tube 350 is optionally set so that the resonance frequency of the anti-resonance by the capacitor Cb and the inductance Mb is located in the predetermined frequency band, it is possible to improve the acoustic characteristic of the headphone 30.

<5. Complement>

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

For example, the case where the headphone according to the present embodiment is a canal-type earphone has been described above as an example, but the technology of the present disclosure is not limited thereto. The headphone according to the present embodiment may be a headphone of another type. For example, the headphone according to the present embodiment may be a so-called overhead-type headphone having a sealed-type front-face air chamber. Here, the overhead-type headphone is a headphone including a pair of housings each accommodating the driver unit provided with the acoustic tube according to the present embodiment, the pair of housings being coupled with each other by a support member curved in an arch shape, the headphone being worn on the head with the support member so that openings provided in the housings for outputting sound toward the outside face the ears of a user. The headphone according to the present embodiment is the overhead-type headphone, the housing and the driver unit are assumed to be enlarged compared with the canal-type earphone. In that case, when a value of each element of the acoustic equivalent circuit is optionally changed according to a change in the characteristic of the housing and the driver unit, it is possible to design a shape of the acoustic tube to improve the acoustic characteristic by the same method as the method described above.

Furthermore, in the description above, a member that can be a resistance component of the ventilation resistance body and the like is not provided in the acoustic tube according to the present embodiment, but the technology of the present disclosure is not limited thereto. In the acoustic tube according to the present embodiment, the ventilation resistance body acting as a resistance component to a flow of air within the tube may be provided. When the ventilation resistance body is provided in the acoustic tube, and a material and a shape of the ventilation resistance body are optionally set, it becomes possible to adjust a value of the resistor Rb2 in the acoustic equivalent circuit of FIG. 2. In this manner, in the present embodiment, the acoustic characteristic may be adjusted by the ventilation resistance body provided in the acoustic tube.

Here, a shape of the housing can be set in consideration of other elements such as wearability and designability of the headphone by a user. Further, as described in <4. Modification> described above, the plurality of driver units and other structural members can be included within the housing according to the intended use of the headphone. In the present embodiment, even when the shape of the housing or the structural members included in the housing are changed in this manner, it is possible to design a shape of the acoustic tube by the same method as the method described above, by optionally changing each element or its value in the acoustic equivalent circuit according to the change.

Additionally, the present technology may also be configured as below.

(1)

A headphone including:

a driver unit that includes a diaphragm;

a housing that accommodates the driver unit, and forms a sealed-type front-face air chamber spatially blocked from an outside except for an opening for sound output on a front face side provided with the diaphragm of the driver unit; and an acoustic tube whose end is directly connected to a first ventilation hole provided in a frame of the driver unit, and that spatially connects a driver-unit rear-face air chamber formed between the frame and the diaphragm with the outside of the driver unit via a tube.

(2)

The headphone according to (1), wherein, in an acoustic equivalent circuit of the headphone, a parallel resonance generating anti-resonance at a predetermined resonance frequency is formed by an acoustic capacitor corresponding to a capacitance component of the driver-unit rear-face air chamber, and an acoustic inductance corresponding to an inductance component of the acoustic tube.

(3)

The headphone according to (2), wherein the resonance frequency is determined at least based on a value of the acoustic inductance and a value of the acoustic capacitor.

(4)

The headphone according to any one of (1) to (3), wherein, in the frame of the driver unit, a second ventilation hole spatially connecting the driver-unit rear-face air chamber with the outside of the driver unit is provided at a position different from a position of the first ventilation hole, wherein, in the second ventilation hole, a ventilation resistance body acting as resistance in the acoustic equivalent circuit of the headphone is provided, and wherein a sound pressure level of the headphone in a predetermined frequency band is determined at least based on a value of an acoustic resistor corresponding to a resistance component of the ventilation resistance body in the acoustic equivalent circuit.

(5)

The headphone according to (4), wherein the sound pressure level of the headphone in the predetermined frequency band is determined at least based on the value of the acoustic capacitor corresponding to the capacitance component of the driver-unit rear-face air chamber, the value of the acoustic inductance corresponding to the inductance component of the acoustic tube in the acoustic equivalent circuit, and the value of the acoustic resistor.

(6)

The headphone according to (3), wherein the value of the acoustic inductance is determined according to a length and an inner cross-sectional area of the acoustic tube, and wherein the length and the inner cross-sectional area of the acoustic tube is set in a manner that the resonance frequency is a value between 200 (Hz) to 400 (Hz).

(7)

The headphone according to (6), wherein, in the acoustic tube, a ratio of the length to the inner cross-sectional area is 76 (1/mmm) to 1124 (1/mm).

(8)

The headphone according to any one of (1) to (7), wherein the acoustic tube includes a tubular member formed of a material having flexibility.

(9)

The headphone according to (8), wherein the frame of the driver unit has a disk shape, and wherein the tubular material is arranged along a circumference direction of the disk shape.

(10)

The headphone according to any one of (1) to (7), wherein the acoustic tube is formed by arranging a rod-like member whose face has a groove formed toward a longitudinal direction in a manner that the face on which the groove is formed is closely fitted to one face on a rear face side opposite to the front face side of the frame of the driver unit, and at least one part of the groove is in contact with the first ventilation hole.

(11)

The headphone according to (10), wherein the frame of the driver unit has a disk shape, and wherein the rod-like member is curved in an arch shape to have curvature equal to or less than a circumference of the disk-like shape, and arranged along a circumference direction of the disk-like shape.

(12)

The headphone according to any one of (1) to (11), wherein the driver unit is a dynamic driver unit.

(13)

The headphone according to (12), wherein a balanced armature driver unit is further accommodated within the housing.

(14)

The headphone according to any one of (1) to (13), wherein the acoustic tube spatially connects the driver-unit rear-face air chamber with the outside of the housing via the tube.

(15)

The headphone according to (14), wherein a rear-face air chamber as a space surrounded by the housing and the driver unit is formed on a rear face side opposite to the front face side of the driver unit, wherein an opening spatially connecting the rear-face air chamber with the outside of the housing is provided in the housing, and wherein the other end of the acoustic tube is provided within the rear-face air chamber.

(16)

The headphone according to (14), wherein the other end of the acoustic tube is provided in the outside of the housing.

(17)

The headphone according to any one of (1) to (16), wherein a sound guiding tube as a tubular part projecting toward the outside is formed in one part of a region constituting the front-face air chamber of the housing, wherein the opening for sound output is provided in a tip end part of the sound guiding tube, and wherein the headphone is a canal-type earphone in which the tip end part of the sound guiding tube is inserted into an external auditory canal of a user.

(18)

The headphone according to any one of (1) to (17), wherein the headphone includes a pair of the housings that accommodate the driver unit, wherein the pair of the housings are coupled with each other by a support member curved in an arch shape, and wherein the headphone is an overhead-type headphone worn on a head of a user with the support member in a manner that the opening for sound output of the housing faces an ear of the user.

(19)

An acoustic characteristic adjusting method including:

accommodating a driver unit that includes a diaphragm within a hosing, and forming a sealed-type front-face air chamber spatially blocked from an outside except for an opening for sound output, between the housing and a front face side provided with the diaphragm of the driver unit; and providing an acoustic tube whose end is directly connected to a first ventilation hole provided in a frame of the driver unit, and that spatially connects a driver-unit rear-face air chamber formed between the frame and the diaphragm with the outside of the driver unit via a tube.

REFERENCE SIGNS LIST

10, 20, 30 headphone
40 acoustic equivalent circuit
110, 210 driver unit
111, 211, 311 frame
116*a*, 116*b*, 116*c*, 216*a*, 216*b*, 316*a*, 316*b* ventilation hole
117*a*, 117*b*, 217*a*, 317*a* ventilation resistance body
118, 218, 318 driver-unit rear-face air chamber
120 front housing
121, 221, 361 opening
125 front-face air chamber
130 rear housing
132 rear-face air chamber
140 housing
310 dynamic-type driver unit
360 middle housing
370 balanced armature-type driver unit (BA-type driver unit)

The invention claimed is:

1. A headphone, comprising:

a driver unit that includes a frame and a diaphragm;

a first housing that accommodates the driver unit, and comprises a driver-unit front-face air chamber defined by the diaphragm of the driver unit and a driver-unit rear-face air chamber opposite to the driver-unit front-face air chamber, wherein the driver-unit front-face air chamber is spatially blocked from an outside of the driver unit except for an opening for sound output on a front face side of the first housing; and an acoustic tube in the driver-unit rear-face air chamber, and including a first end and a second end, wherein the first end is directly connected to a first ventilation hole in the frame of the driver unit, and the acoustic tube spatially connects the driver-unit rear-face air chamber with the outside of the driver unit.

2. The headphone according to claim 1, wherein, in an acoustic equivalent circuit of the headphone, a parallel resonance generating anti-resonance at a resonance frequency is generated by an acoustic capacitor corresponding to a capacitance component of the driver-unit rear-face air chamber, and an acoustic inductance corresponding to an inductance component of the acoustic tube.

3. The headphone according to claim 2, wherein the resonance frequency is based on at least one a first value of the acoustic inductance or a second value of the acoustic capacitor.

4. The headphone according to claim 3, wherein the frame of the driver unit further comprises:

a second ventilation hole that spatially connects the driver-unit rear-face air chamber with the outside of the driver unit at a second position that is different from a first position of the first ventilation hole, wherein the second ventilation hole further comprises a ventilation resistance body acts as resistance in the acoustic equivalent circuit of the headphone, and wherein a sound pressure level of the headphone in a frequency band is at least based on a third value of an acoustic resistor corresponding to a resistance component of the ventilation resistance body in the acoustic equivalent circuit.

5. The headphone according to claim 4, wherein the sound pressure level of the headphone in the frequency band is at least based on the second value of the acoustic capacitor corresponding to the capacitance component of the driver-unit rear-face air chamber, the first value of the acoustic inductance corresponding to the inductance component of the acoustic tube in the acoustic equivalent circuit, and the third value of the acoustic resistor.

6. The headphone according to claim 3, wherein the first value of the acoustic inductance is based on a length and an inner cross-sectional area of the acoustic tube, and wherein the length and the inner cross-sectional area of the acoustic tube are set in a manner that the resonance frequency is between 200 (Hz) to 400 (Hz).

7. The headphone according to claim 6, wherein, in the acoustic tube, a ratio of the length to the inner cross-sectional area is 76 (1/mmm) to 1124 (1/mm).

8. The headphone according to claim 1, wherein the acoustic tube includes a flexible tubular member.

9. The headphone according to claim 8, wherein the frame of the driver unit has a disk shape, and wherein the flexible tubular member is arranged along a circumference direction of the disk shape.

10. The headphone according to claim 1, wherein the acoustic tube comprises a rod-like member having a first face that has a groove toward a longitudinal direction, and wherein the acoustic tube is arranged in a manner that the first face with the groove closely fits to a second face opposite to the first face of the frame of the driver unit, and at least one part of the groove is in contact with the first ventilation hole.

11. The headphone according to claim 10, wherein the frame of the driver unit has a disk shape, and wherein the rod-like member is curved in an arch shape to have curvature equal to or less than a circumference of the disk shape, and arranged along a circumference direction of the disk shape.

12. The headphone according to claim 1,
wherein the driver unit is a dynamic driver unit.

13. The headphone according to claim 12,
wherein the first housing is further configured to accommodate a balanced armature driver unit.

14. The headphone according to claim 1,
wherein the acoustic tube spatially connects the driver-unit rear-face air chamber with the outside of the first housing via a tube.

15. The headphone according to claim 14,
wherein the second end of the acoustic tube is within the driver-unit rear-face air chamber.

16. The headphone according to claim 14,
wherein the second end of the acoustic tube is outside of the first housing.

17. The headphone according to claim 1,
wherein at least a part of the driver-unit front-face air chamber comprises a sound guiding tube as a tubular part projecting toward the outside,
wherein the opening for the sound output is in a tip end part of the sound guiding tube, and
wherein the headphone is a canal-type earphone in which the tip end part of the sound guiding tube is inserted into an external auditory canal of a user.

18. The headphone according to claim 1,
wherein the headphone further comprises a second housing,
wherein the first housing and the second housing are coupled with each other by a support member curved in an arch shape, and
wherein the headphone is an overhead-type headphone configured to be worn on a head of a user with the support member in a manner that the opening for the sound output of the first housing faces an ear of the user.

19. An acoustic characteristic adjusting method, comprising:
accommodating a driver unit that includes a frame and a diaphragm within a housing, wherein the housing comprises a driver-unit front-face air chamber defined by the diaphragm of the driver unit and a driver-unit rear-face air chamber opposite to the driver-unit front-face air chamber;
blocking, spatially, the driver-unit front-face air chamber from an outside except for an opening for sound output, between the housing and a front face side of the housing; and
providing an acoustic tube having a first end and a second end in the driver-unit rear-face air chamber, wherein the first end is directly connected to a first ventilation hole in the frame of the driver unit, and the acoustic tube spatially connects the driver-unit rear-face air chamber with the outside of the driver unit.

* * * * *